US012656010B2

(12) United States Patent
Paiho et al.

(10) Patent No.: US 12,656,010 B2
(45) Date of Patent: Jun. 16, 2026

(54) METHOD OF OPERATING AN AIR CLEANING CLUSTER

(71) Applicant: ZEHNDER GROUP INTERNATIONAL AG, Gränichen (CH)

(72) Inventors: Janne Paiho, Motala (SE); Magnus Bladh, Stockholm (SE)

(73) Assignee: ZEHNDER GROUP INTERNATIONAL AG, Gränichen (CH)

( * ) Notice: Subject to any disclaimer, the term of this patent is extended or adjusted under 35 U.S.C. 154(b) by 446 days.

(21) Appl. No.: 18/031,226

(22) PCT Filed: Oct. 21, 2021

(86) PCT No.: PCT/EP2021/079268

§ 371 (c)(1),
(2) Date: Apr. 28, 2023

(87) PCT Pub. No.: WO2022/084473

PCT Pub. Date: Apr. 28, 2022

(65) Prior Publication Data

US 2023/0375208 A1 Nov. 23, 2023

(30) Foreign Application Priority Data

Oct. 23, 2020 (CH) ..... 01360/20

(51) Int. Cl.
*F24F 11/65* (2018.01)
*F24F 3/16* (2021.01)
*F24F 110/50* (2018.01)

(52) U.S. Cl.
CPC ..... *F24F 11/65* (2018.01); *F24F 3/16* (2013.01); *F24F 2110/50* (2018.01)

(58) Field of Classification Search
CPC ..... F24F 3/06; F24F 3/065; F24F 3/08; F24F 3/10; F24F 11/00; F24F 11/30;
(Continued)

(56) References Cited

U.S. PATENT DOCUMENTS 10,139,118 B2 * 11/2018 Law ..... B01D 46/0045
2019/0232210 A1 8/2019 Hur et al.

FOREIGN PATENT DOCUMENTS

CH 713 392 A1 7/2018
CN 104633774 A 5/2015
CN 109059099 A 12/2018
CN 110094828 A * 8/2019 ..... F24F 11/77
(Continued)

OTHER PUBLICATIONS

Qin et al. Translation for CN 109059099 (Year: 2018).*
Translation for CN-109059099.*
EPO (Rijswijk, NL), English language version of the International Search Report, Form PCT/ISA/210, for International Application PCT/EP2021/079268, Jan. 20, 2022 (4 pages).
(Continued)

*Primary Examiner* — Thomas K Pham
(74) *Attorney, Agent, or Firm* — Pauley Erickson & Swanson

(57) ABSTRACT

A computer implemented method of operating an air cleaning cluster includes a plurality of air cleaning devices interconnected to each other by a volume of air, each air cleaning device being configured to remove contaminants from the volume of air, the method including: receiving, by control device(s) from air quality data sources, data indicative of air quality within the volume of air; receiving, by the control device(s), data indicative of operational state(s) of the air cleaning devices; and the control device(s) controlling the air cleaning device(s) of the air cleaning cluster such as to influence the indoor air quality within the volume of air, using the data indicative of the indoor air quality and the data indicative of an operational state of the plurality of air cleaning devices.

14 Claims, 15 Drawing Sheets

(58) Field of Classification Search
CPC .. F24F 11/32; F24F 11/33; F24F 11/34; F24F 11/35; F24F 11/36; F24F 11/37; F24F 11/38; F24F 11/39; F24F 11/41; F24F 11/42; F24F 11/43; F24F 11/46; F24F 11/47; F24F 11/48; F24F 11/49; F24F 11/50; F24F 11/52; F24F 11/523; F24F 11/526; F24F 11/54; F24F 11/56; F24F 11/57; F24F 11/58; F24F 11/59; F24F 11/61; F24F 11/62; F24F 11/63; F24F 11/64; F24F 11/65; F24F 11/67; F24F 11/70; F24F 11/72; F24F 11/74; F24F 11/745; F24F 11/75; F24F 11/755; F24F 11/76; F24F 11/77; F24F 11/79; F24F 11/80; F24F 11/81; F24F 11/83; F24F 11/84; F24F 11/85; F24F 11/86; F24F 11/87; F24F 11/871; F24F 11/873; F24F 11/875; F24F 11/88; F24F 2110/22; F24F 2110/30; F24F 2110/32; F24F 2110/52; F24F 11/66; G05B 2219/2614; G05B 2219/2638; G05B 2219/2648
See application file for complete search history.

(56) References Cited

FOREIGN PATENT DOCUMENTS

| | | | | | |
|---|---|---|---|---|---|
| CN | 110612420 | A | | 12/2019 | |
| CN | 110793160 | A | | 2/2020 | |
| EP | 0 743 378 | A1 | | 11/1996 | |
| EP | 0743578 | B1 | * | 8/2001 | ..... F24F 8/10 |
| EP | 2 476 968 | A1 | | 7/2012 | |
| WO | WO 2016/032903 | A1 | | 3/2016 | |
| WO | WO-2019151684 | A1 | * | 8/2019 | ..... F24F 11/38 |

OTHER PUBLICATIONS

China Patent Office, (CNIPO), Bijing, P.R. China, Office Action for Chinese Patent Application No. 202180071826.5, Issued Jul. 1, 2025 (14 pages).

China Patent Office, (CNIPO), Beijing, P.R. China, Search Report for Chinese Patent Application No. 202180071826.5, Issued Jun. 30, 2025 (2 pages).

* cited by examiner

METHOD OF OPERATING AN AIR CLEANING CLUSTER

CROSS REFERENCE TO RELATED APPLICATION

This application is a National Phase filing in the United States, under 35 USC § 371, of PCT International Patent Application PCT/EP2021/079268, filed on 21 Oct. 2021 which claims the priority of Swiss Patent Application CH 01360/20, filed on 23 Oct. 2020.

The above-referenced applications are hereby incorporated by reference herein in their entirety and is made a part hereof, including but not limited to those portions which specifically appear hereinafter.

BACKGROUND OF THE INVENTION

Field of the Invention

The present disclosure relates to a computer implemented method of operating an air cleaning cluster comprising a plurality of air cleaning devices arranged within a volume of air. The present disclosure further relates to a control device for controlling an air cleaning cluster; an air cleaning device; an air cleaning system; and a computer program product.

Discussion of Related Art

Indoor air quality is a term referring to the air quality within buildings and structures, affecting the health and comfort of building occupants. Indoor air quality is an important topic since people spend as much as 90% of their time indoors, either at home, work, or school. Therefore, the indoor environment is important to health and welfare. Indoor air quality can be affected by microbial contaminants (mold, bacteria), gases (including carbon monoxide, radon, volatile organic compounds), particulates, or any mass or energy stressor that can induce adverse health conditions. Indoor air is becoming an increasingly more concerning health hazard than outdoor air. Furthermore, Indoor air quality not only affects the health and comfort of occupants but has significant impact on industrial processes, greatly affecting the quality of products produced as well as the production machines themselves. For example, the chemical industry, in particular the pharmaceutical industry has very strict standards defined not only to ensure product quality but also to meet regulatory requirements. As a further example, the semiconductor industry, in particular the productions of semiconductor-based circuitry is highly sensitive to contaminants, wherein even dust particles on a scale of nanometers jeopardize the quality of semiconductor circuitry.

Using ventilation (natural and/or mechanical) to dilute contaminants, filtration, and source control have long been the primary methods for improving indoor air quality in most buildings. Ventilation is the process of supplying fresh air to an enclosed space (a volume of air) in order to refresh/remove/replace the existing air. Ventilation is commonly used to remove contaminants such as fumes, dusts or vapors and provide a healthy and safe working environment; in other words, it is an engineering control with the purpose to remove 'stale' indoor air from a building and its replacement with 'fresh' outside air. It is either assumed that the outside air is of reasonable quality, or the outside air is cleaned before being allowed to enter the indoor space. Ventilation can be accomplished by natural means (e.g., opening a window) or mechanical means (e.g. fans or blowers). Ventilation should not be confused with exhaust. For example, in the case of combustion equipment such as water heaters, boilers, fireplaces, and wood stoves, exhausts are provided to carry the products of combustion which have to be expelled from the building in a way which does not cause harm to the occupants of the building. Movement of air between indoor spaces, and not the outside, is called transfer.

However, with the dramatic increase in energy costs, great efforts have been and are being made to prevent leakage of outside air into or conditioned air out of buildings, e.g., by constructing airtight buildings. Furthermore, due to the increased costs of bringing the outside air to temperature and/or humidity levels to comfortable/regulation compliant levels (e.g., by heating, respectively cooling), the ventilation, i.e., the exchange inside and outside air is to be reduced as far as possible.

In order to be able to improve/maintain indoor air quality and at the same time minimize the energy losses due to ventilation, air cleaning has become an established method in the management of indoor air quality. Air Cleaning refers to the process of removing (at least a portion of) contaminants from a volume of air by recirculation. According to air cleaning, as opposed to ventilation, contaminants are not diluted by "fresh" air but removed from the volume of air. It shall be noted that most installations for management of indoor air quality employ a combination of ventilation and air cleaning.

Air cleaning is usually performed by the use of one or more air cleaning devices arranged within a volume of air, the air cleaning devices being configured to remove at least a portion of contaminants from the volume of air by recirculation. State of the art air cleaning devices are configured to draw in air from a volume of air through an air inlet; force at least a portion of the drawn-in air through one or more air cleaning filters to physically capture a portion of contaminants from the portion of the drawn-in air; and to return at least a portion of the filtered air through an air outlet back to the volume of air.

In order to adapt to different environments affected by different contaminants, different types and sizes of air cleaning filters, respectively different types and sizes of air cleaning devices are available to capture the respective contaminants.

In order to manage indoor air quality of large and/or highly sensitive indoor environments, several, independent air cleaning devices are known to be installed within a volume of air wherein each air cleaning device is operated independently from the other air cleaning devices arranged in the air volume.

Indoor air quality is a result of the interaction of a complex set of factors. Each of these factors must be considered when managing indoor air quality. Indoor air quality professionals use the four factors listed below as a basis for an investigative approach.

Source: The source of contamination or discomfort indoors, outdoors, or within the mechanical systems of the building.

Ventilation: The ability of the ventilation system to control existing air contaminants and ensure thermal comfort (temperature and humidity conditions that are comfortable for most occupants).

Pathways: The one or more contaminant pathways connecting the contaminant source to the occupants, production equipment and/or products produced with the existing driving force moving contaminants along the pathway(s).

Occupants: Building occupants are present and are affected enough to raise indoor air quality concerns.

Determination of indoor air quality involves the collection of air (air samples), monitoring human exposure to contaminants, collection of samples on building surfaces and computer modeling of air flow inside buildings.

However, indoor air quality within a volume of air is not static but strongly influenced by a variety of internal factors, such as activities in the room/hall/building and/or external factors, such as open doors, windows, variations in the levels of ventilation. In addition, in a larger volume of air the internal factors may depend on the location within the volume of air. On the other hand, the performance of air cleaning devices is also not constant over their operational lifetime. For example, filter degradation or a malfunction greatly decreases the performance of an air cleaning device over time. Known installations of air cleaning devices are not able to ensure indoor air quality of such dynamically changing environments, neither are they able to react to the internal and external factors, nor are they able to manage the variation in the performance of the air cleaning devices of air cleaning cluster.

SUMMARY OF THE INVENTION

It is an objective of the present disclosure to provide a method, a control device and a computer program product for operating an air cleaning cluster that overcomes at least some of the disadvantages of the prior art. It is a further objective of the present disclosure to provide an air cleaning device for operation in an air cleaning cluster and an air cleaning system that overcomes at least some of the disadvantages of the prior art.

In particular, it is an objective of the present disclosure to provide a method, a control device and a computer program product for operating a managed air cleaning cluster in a coordinated manner and, if appropriate, considering local incidents that allows maintenance of indoor air quality in an efficient manner even in dynamically changing environments.

Faced with the above-identified objectives, in a first aspect, it has been observed that merely dimensioning a plurality of independent air cleaning devices based on a set of assumptions related to the air quality level within a volume of air (e.g., assumed internal and/or external factors affecting contamination, assumed degradation and lifetime of air cleaning devices) is not sufficient to maintain air quality effectively over an extended period of time. In a known approach, estimated variations of the assumptions are taken into consideration when designing the plurality of independent air cleaning devices in an attempt to ensure indoor air quality under all expected circumstances. However, such an approach inadvertently leads to over dimensioning of the plurality of independent air cleaning devices and is hence a very inefficient approach.

Furthermore, in a second aspect, it has been observed that controlling individual air cleaning devices in isolation leads to inefficiencies and limitations of the ability to maintain indoor air quality. For example, a particular air cleaning device of an air cleaning cluster may be more suited to remove a particular contaminant from the volume of air than another air cleaning device. However, isolated control (i.e., without a holistic view over the entire air cleaning cluster and without considering local conditions) of the individual air cleaning devices would not allow transfer of the air cleaning load from one air cleaning device to the other.

The plurality of air cleaning devices of an air cleaning cluster according to the present disclosure are arranged in and thereby interconnected to each other by a volume of air. As used herein, the phrase "interconnected to each other by a volume of air" refers to the air cleaning devices being arranged/installed such that there is an air communication between them, including in particular the air cleaning devices being arranged in the same building part/division enclosed by walls, floor, and ceiling (room) or in different rooms interconnected by at least one air channel, such as a duct. The phrase "interconnected to each other by a volume of air" is not to be interpreted as to cover air cleaning devices arranged in fluidly isolated building parts, building parts fluidly connected merely by unintentional lack of airtightness, or building parts fluidly connected by a ventilation system (e.g., an air cleaning device located on the inside and another air cleaning device located on the outside of a building part or building).

The air cleaning devices arranged into an air cleaning cluster are configured to remove at least a portion of contaminants from the volume of air. According to embodiments disclosed herein, the air cleaning devices remove contaminants from the volume of air by recirculation, that is by drawing in air from the volume of air through an air inlet; forcing at least a portion of the drawn-in air through one or more air cleaning filters to physically capture a portion of contaminants from the portion of the drawn-in air; and returning at least a portion of the filtered air through the air outlet back to the volume of air. In particular, the air cleaning devices draw the air in; force the air through air cleaning filters and returning the filtered air aided by air propelling means such as a fan. Good results are achieved by air cleaning devices which comprise a housing and therein arranged one or several filters of the same or different kind (e.g., arranged in a serial manner). According to embodiments of the present disclosure the filters of the air cleaning device(s) further comprise molecular filtration means; UV-light based decontamination means and/or photocatalystic decontamination means.

The housing usually comprises at least one inlet and at least one outlet. At least one fan is arranged, with respect to the direction of air flow, on the rear side of the filters. Air from the air volume is drawn into the housing by the at least one inlet, in that the at least one fan produces an underpressure on the rear side of the at least one filter. The air is freed from pollution, before it passes the at least one fan and exits the housing by the at least one outlet. The at least one outlet may be equipped with at least one air guide flap to influence the direction of the exiting air. The air cleaning device usually comprises at least one sensor (pressure, temperature, humidity, etc.) to generate data indicative of operational state(s) of the air cleaning device. Depending on the particular embodiment, the air cleaning device further comprises a control device as described hereinafter in more detail.

The method of operating an air cleaning cluster according to the present disclosure comprises: one or more control device(s) receiving data indicative of air quality within the volume of air; and the control device(s) receiving data indicative of operational state(s) of the plurality of air cleaning devices. In particular, the data indicative of air quality originates from air quality data sources such as air quality sensors communicatively connected to one or more control device(s). The air quality sensors are arranged within the same air volume as the air cleaning devices. According to particular embodiments, data indicative of air quality also originates from external data sources such as contamination level data sources external to the volume of air but indirectly affecting the indoor air quality within the volume of air due to ventilation. The data indicative of air quality comprises measurement values such as concentration(s) and/or distribution of particular contaminant(s)/particle(s). The data indicative of operational states of the air cleaning devices comprises data such as load level and/or filter degradation level of the plurality of air cleaning devices. In particular, the data indicative of operational states of the air cleaning devices originates from the air cleaning devices themselves. Alternatively, or additionally, data indicative of operational states of the air cleaning devices is provided by a computing system aggregating and/or predicting operational states of air cleaning devices, in particular based on historical and/or statistical operational data.

According to the method of operating an air cleaning cluster according to the present disclosure, the control device(s) (in particular a processor thereof) control one or more of the plurality of air cleaning devices of the air cleaning cluster such as to influence the indoor air quality within the volume of air. In particular, the step of controlling the air cleaning cluster comprises controlling one or more of plurality of air cleaning devices of the air cleaning cluster such that the data indicative of air quality from the one or more air quality data sources corresponds to an indoor air quality target value. According to embodiments of the present disclosure, the indoor air quality target value is a constant value or a value changing according to a schedule, such as an indoor air quality target value schedule determined corresponding to scheduled activity within the volume of air.

The control device(s) controls the plurality cleaning device(s) using both the data indicative of the indoor air quality and the data indicative of an operational state of the plurality of air cleaning devices. Thereby, as a combined solution to address the first and second aspects mentioned above, the present disclosure provides a method of operating an air cleaning cluster having a plurality of air cleaning devices based not on assumptions but based on data indicative of air quality within the volume of air as well as data indicative of operational state(s) of the plurality of air cleaning devices of the air cleaning cluster.

According to embodiments of the present disclosure, the operational state(s) comprise data indicative of load level(s) of the plurality of air cleaning devices (e.g., 10% load, 10 W of 100 W max load, 10 m3/h of a max of 100 m3/h load, etc.), the method further comprising the control device controlling the air cleaning cluster such as to:

Achieve a load balance between the plurality of air cleaning devices. The load balance may be an equal load between the plurality of air cleaning devices, or a balanced load based on the local type and local concentration of contaminants as measured by the air quality sensor(s).

Set one or more of the plurality of air cleaning devices to a load level at or below a threshold efficiency level. Even though having a higher maximum capacity (e.g., higher amount of clean air delivery rate), certain air cleaning devices are most energy efficient up to a certain load level. For example, the increase of air resistance of certain air cleaning filters (the pressure drop between the inlet and outlet side of the air cleaning filters) with the increase of air volume is non-linear. Therefore, in order to improve energy efficiency, according to embodiments of the present disclosure, the load is distributed between several air cleaning devices such as to ensure that each air cleaning device is operating efficiently vs. the entire air cleaning load being carried by a single air cleaning device operating at a high but inefficient load while other air cleaning devices being idle. Energy efficiency is expressed for example as the amount of energy required to deliver a certain flow rate of clean air W/(m3/h).

Set one or more of the plurality of air cleaning devices below an increased wear level. Beyond becoming inefficient, even though having a higher maximum capacity (e.g., higher amount of clean air delivery rate), certain air cleaning devices are prone to increased wear beyond a certain load level. Therefore, in order to prolong the lifetime of air cleaning devices, according to embodiments of the present disclosure, the load is distributed between several air cleaning devices such as to ensure that none of the air cleaning devices is operating beyond their increased wear level.

According to embodiments of the present disclosure, the operational state(s) comprises data indicative of a degradation level of a first air cleaning device of the plurality of air cleaning devices, the method further comprising the control device controlling one or more of the plurality of air cleaning devices other than the first air cleaning device such as to compensate for the degradation level of the first air cleaning device. The feature "compensate for the degradation level of the first air cleaning device" comprises the process of increasing the load level (power setting) of one or more air cleaning devices (other than the first air cleaning device) at least temporarily until servicing/replacement of the degraded first air cleaning device. The temporal increase of the load level of one or more air cleaning devices (other than the first air cleaning device) may go even beyond the above-mentioned balance; threshold efficiency and/or increased wear levels.

The degradation level comprises data indicative of percentage of remaining contaminant removal efficiency, contaminant holding capacity and resistance to airflow of the air cleaning filters. Additionally, the degradation level comprises data indicative of a degradation of further components of the air cleaning devices, such as the air propelling means. According to embodiments of the present disclosure, the control device switches the first air cleaning device into a service state if the data indicative of a degradation level is above a service threshold and generates an alert signal identifying the first air cleaning device. The alert signal may be an audible, a visual signal and/or an alert message sent by data communication means, for example to a system owner, a service technician, a back office, or even R&D for statistical purposes.

According to embodiments of the present disclosure, the data indicative of air quality originates from air quality sensor(s) and/or air quality data sources. The data indicative of air quality comprises data indicative of a contamination type within the volume of air, in particular particle size of the contamination. Accordingly, the method of operating an air cleaning cluster further comprises:

Receiving, by the control device, data indicative of a contamination type each of the plurality of air cleaning devices is configured to remove (or is most suited to remove) from the volume of air. The data indicative of a contamination type each of the plurality of air cleaning devices is configured to remove may originate from the air cleaning devices themselves. Alternatively, or additionally the data indicative of a contamination type each of the plurality of air cleaning devices is configured to remove may be retrieved by the control device from a configuration file corresponding to the air cleaning cluster.

The control device controlling the air cleaning cluster using the data indicative of a contamination type each of the plurality of air cleaning devices is configured to remove and the data indicative of a contamination type of the volume of air. In particular, the control device increases the load level of the air cleaning devices best suited to remove the contamination type detected by the air quality sensor(s) while maintaining or reducing the load level of air cleaning devices not suited therefor.

Such embodiments are particularly advantageous as they enable the air cleaning cluster to dynamically adapt to a changing environment and allow efficient use of the available resources, namely the air cleaning devices.

Embodiments according to the present disclosure comprise a forward-looking (predictive) aspect, wherein, the control device receives data indicative of an expected indoor air quality impact (such as an indication of increased activity within the volume of air). Having such data available, the control device controls the air cleaning cluster further using the data indicative of an expected air quality impact. Hence, the air cleaning cluster is able to pre-emptively adapt to a change of indoor air quality, even before such is detected by the air quality sensors/data sources. For example, the expected indoor air quality impact may comprise data indicative that a certain industrial process will be started at a scheduled point in time, activity which is associated with a particular contamination of the volume of air. As a preemptive measure, the control device instructs the air cleaning device best suited to remove the particular contaminant resulting from said activity exactly when the activity is scheduled to start, even before the indoor air quality is affected. In such a way, the control device is able to take preventive action to avoid degradation of indoor air quality. On the other hand, the expected indoor air quality impact may comprise data indicative that a certain industrial process will be completed at a scheduled point in time hence user presence will be reduced. In order to conserve energy, the control device instructs the air cleaning devices configured to remove the particular contaminant resulting from said activity even before the activity is scheduled to complete, anticipating a drop in the need to maintain the indoor air quality beyond user presence.

Furthermore, data indicative of an expected indoor air quality impact may comprise external data such as Indoor Air Quality index forecast data comprising for example actual or expected pollen or NOx concentrations.

With respect to the layout of the air cleaning system as deployed in a volume of air, the following topologies are envisaged according to embodiments of the present disclosure:

Mesh topology: The air cleaning system comprising a plurality of control devices distributed in the volume of air and arranged in a mesh network configuration. In such a system layout, the plurality of control devices collaboratively control the air cleaning cluster. In order to achieve the collaborative control of the air cleaning cluster, the plurality (i.e., 2 or more) of control devices are communicatively connected with each other and exchange data indicative of air quality, data indicative of operational state(s) (of the plurality of air cleaning devices) and/or data indicative of the respective control device controlling one or more of the plurality of air cleaning devices of the air cleaning cluster. In such a distributed topology, one or more of the plurality of control devices may be integrated into respective air cleaning devices.

Mesh topology is advantageous as the air cleaning system has no single point of failure. Furthermore, air cleaning devices with an integrated/dedicated control device can easily be deployed into an existing air cleaning cluster, thereby extending the mesh network. In a mesh topology, good results can be achieved when each air cleaning device is "smart" in the sense that it has an integrated/dedicated control device configured to control the respective air cleaning device as part of the air cleaning cluster.

Star topology: The air cleaning system comprises at least one "master" control device communicatively connected to the plurality of air cleaning devices of the air cleaning cluster and to a plurality of air quality sensors/data sources and controlling the plurality of air cleaning devices such as to influence the indoor air quality within the volume of air.

In a star topology, not all air cleaning devices must be "smart" in the sense that they are self-controlling. Instead, the so called "master" control device is provided to control "non-smart" air cleaning devices (air cleaning devices without an integrated/dedicated control device). This reduces the complexity of the individual air cleaning devices and is advantageous in particular for upgrading existing air cleaning systems comprising a plurality of existing air cleaning devices, in particular upgrading air cleaning devices of different types or even manufacturers. Having at least one "master" control device connected to a plurality of air cleaning devices of the air cleaning cluster simplifies maintenance of the air cleaning system.

Mixed topology: According to particular embodiments of the present disclosure, the air cleaning system is deployed in a volume of air in a mixed topology, wherein a first subset of air cleaning devices comprise an integrated/dedicated control device which form a mesh topology network to exchange data between themselves, while a second subset of air cleaning devices are controlled by a single control device in a star topology network.

A mixed topology combines the advantages of a mesh and a star topologies, avoiding single points of failure, while allowing easily upgrading existing "non-smart" air cleaning devices.

According to embodiments of the method of present disclosure for operating an air cleaning cluster deployed in a mesh or mixed topology, the method further comprises:

establishing a data communication link between the plurality of control devices;

establishing a data communication link between each of the plurality of control devices and one or more of the plurality of air cleaning devices; and the plurality of control devices exchanging data indicative of the respective control device controlling one or more of the plurality of air cleaning devices of the air cleaning cluster.

The data communication links established between the plurality of control devices and/or the data communication links established between each of the plurality of control devices are wired (such as Ethernet) and/or radio communication links (such as WiFi, Bluetooth, or mobile telecommunication links).

According to embodiments of the present disclosure, a remote server is provided to collect and process data from a plurality of air cleaning clusters in order to take advantage of the compounded data set throughout a plurality of environments. Correspondingly, the method further comprises:

The remote server collecting data indicative of indoor air quality and data indicative of operational state(s) from a plurality of air cleaning clusters arranged within a plurality of volumes of air. According to the particular use case, the plurality of volumes of air are located in the same and/or in different buildings.

The remote server generating control parameters using the data collected from the plurality of air cleaning clusters.

The remote server transmitting the control parameters to the control device(s).

The control device(s) controlling the air cleaning cluster further using the control parameters transmitted by the remote server. In particular, the control parameters are intended to further refine the control algorithms of the control devices based on experience of different environments as reflected by the data collected by the remote server.

According to the present disclosure, the above-mentioned objective(s) are further addressed by a control device comprising processing means and storage means, the storage means comprising computer-executable instructions, which when executed by the processing means cause the control device to carry out the method according to one of the embodiments disclosed herein. The control device may be a stand-alone device intended to be used in a star topology (see above), a device configured to be integrated into an air cleaning device in a mesh topology, and/or a generic device suitable to be used both as a stand-alone device or to be integrated into an air cleaning device.

According to the present disclosure, the above-mentioned objective(s) are further addressed by an air cleaning device for removing at least a portion of contaminants from a volume of air, the air cleaning device comprising: a control device according to one of the embodiments disclosed herein; an air inlet; one or more air cleaning filters; air propelling means; and an air outlet. The air cleaning device is configured to: draw in air from the volume of air through the air inlet; force, by the air propelling means, at least a portion of the drawn-in air through the one or more air cleaning filters to physically capture a portion of contaminants from the portion of the drawn-in air; and return at least a portion of the filtered air through the air outlet back to the volume of air.

According to the present disclosure, the above-mentioned objective(s) are further addressed by an air cleaning system comprising: an air cleaning cluster comprising a plurality of air cleaning devices configured to remove at least a portion of contaminants from the volume of air; one or more air quality data sensors configured to measure an air quality within the volume of air and to make available data indicative of air quality; and one or more control device(s) according to one of the embodiments disclosed herein. According to embodiments of the present disclosure, the control device(s) is/are located physically remote from the air cleaning devices and/or comprised by the plurality of air cleaning devices.

According to the present disclosure, the above-mentioned objective(s) are further addressed by a computer program product comprising computer-executable instructions, which when executed by a processing unit (such as a CPU) of one or more control device(s) cause the control device(s) to carry out the method according to one of the embodiments disclosed herein.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF SEVERAL VIEWS OF THE DRAWINGS

The herein described disclosure will be more fully understood from the detailed description given herein below and the accompanying drawings which should not be considered limiting to the disclosure described in the appended claims.

FIG. 1.1 shows a highly schematic perspective view of a first embodiment of an air cleaning device according to the present disclosure;

DETAILED DESCRIPTION OF THE INVENTION

Figure 1:
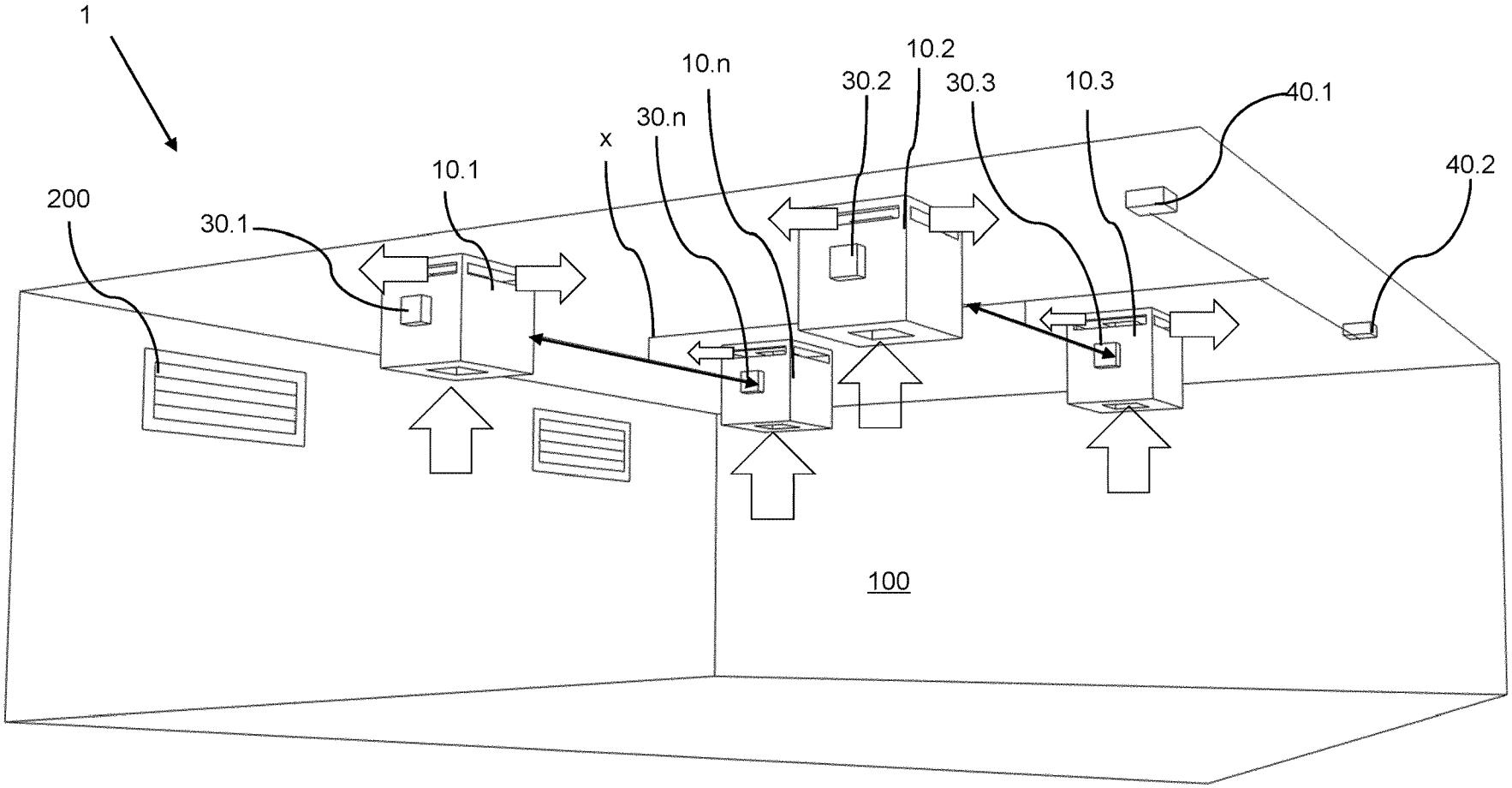
FIG. 1 shows a highly schematic perspective view of first embodiment of an air cleaning system according to the present disclosure, installed within a room (volume of air) in a distributed (mesh) topology.

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

As used herein, the term "contaminant" refers to any kind of particles of interest within a volume of air. In particle theory contaminants/particles are split based on how the particles have been formed, e.g., dust, mist and aerosols:

Dust is formed usually by decomposition of solid materials, such as crushing of stone, rock drilling and grinding of metal. Dust consists of solid particles in the range 1 micrometer to a few tenths of a millimeter.

Mist may be formed either by decomposition of a liquid (atomization) such as the use of cutting fluids or by condensation, for example by cooling of moist air.

Aerosols are suspensions of solid particles or liquid particles in gases. Aerosols may have particle diametric from 0.01 μm to 100 μm, typical concentrations in workplaces can be 1 μg/m3 to 100 mg/m3, in extreme places up to 10 g/m3.

Nodular particles are spherical in shape, acicular particles are needle-shaped (fibers of various kinds, such as asbestos, mineral fiber, textile fiber), laminar particles are flat shaped (e.g., talc, graphite). Small particles often form aggregates (cluster) of larger size. This applies, for example, to the particles in engine exhaust and welding smoke.

In order to be able to identify the proper means to remove contaminants, particles are commonly categorized. Among the most common categorizations imposed on particles are those with respect to size, referred to as fractions. As particles are often non-spherical (for example, asbestos fibers), there are many definitions of particle size. The most widely used definition is the aerodynamic diameter. A particle with an aerodynamic diameter of 10 micrometers moves in a gas like a sphere of unit density (1 gram per cubic centimeter) with a diameter of 10 micrometers. PM diameters range from less than 10 nanometers to more than 10 micrometers. These dimensions represent the continuum from a few molecules up to the size where particles can no longer be carried by a gas.

| Fraction | Size range |
|---|---|
| PM10 (thoracic fraction) | <=10 μm |
| PM2.5 (respirable fraction) | <=2.5 μm |
| PM1 | <=1 μm |
| Ultrafine (UFP or UP) | <=0.1 μm |
| PM10-PM2.5 (coarse fraction) | 2.5 μm-10 μm |

It shall be noted that the above are formal definitions. Depending on the context, alternative definitions may be applied. In some specialized settings, each fraction may exclude the fractions of lesser scale, so that PM10 excludes particles in a smaller size range, e.g. PM2.5, usually reported separately in the same work. Such a case is sometimes emphasized with the difference notation, e.g. PM10-PM2.5. Other exceptions may be similarly specified. This is useful when not only the upper bound of a fraction is relevant to a discussion. The fact that some particle size ranges require greater air cleaning filter strength and the smallest ones can outstrip the body's ability to keep them out of cells both serve to guide understanding of related public policy, environment, and health topics.

Furthermore, contaminant particles are categorized by their composition. The composition of aerosol particles depends on their source. Wind-blown mineral dust tends to be made of mineral oxides and other material blown from the Earth's crust; this aerosol is light-absorbing. Sea salt is considered the second-largest contributor in the global aerosol budget, and consists mainly of sodium chloride originated from sea spray; other constituents of atmospheric sea salt reflect the composition of sea water, and thus include magnesium, sulfate, calcium, potassium, etc. In addition, sea spray aerosols may contain organic compounds, which influence their chemistry. Sea salt does not absorb.

Secondary particles derive from the oxidation of primary gases such as sulfur and nitrogen oxides into sulfuric acid (liquid) and nitric acid (gaseous). The precursors for these aerosols, i.e., the gases from which they originate, may have an anthropogenic origin (from fossil fuel combustion) and a natural biogenic origin. In the presence of ammonia, secondary aerosols often take the form of ammonium salts; i.e., ammonium sulfate and ammonium nitrate (both can be dry or in aqueous solution); in the absence of ammonia, secondary compounds take an acidic form as sulfuric acid (liquid aerosol droplets) and nitric acid (atmospheric gas). Secondary sulfate and nitrate aerosols are strong light scatterers. This is mainly because the presence of sulfate and nitrate causes the aerosols to increase to a size that scatters light effectively.

Organic matter (OM) can be either primary or secondary, the latter part deriving from the oxidation of VOCs; organic material in the atmosphere may either be biogenic or anthropogenic. Organic matter influences the atmospheric radiation field by both scattering and absorption. Another important aerosol type is constituted of elemental carbon (EC, also known as black carbon, BC): this aerosol type includes strongly light-absorbing material and is thought to yield large positive radiative forcing. Organic matter and elemental carbon together constitute the carbonaceous fraction of aerosols.

The chemical composition of the aerosol directly affects how it interacts with solar radiation. The chemical constituents within the aerosol change the overall refractive index. The refractive index will determine how much light is scattered and absorbed.

Turning now to the figures, specific embodiments of the present disclosure shall be described.

FIG. 1 shows a highly schematic perspective view of first embodiment of an air cleaning system 1 according to the present disclosure. The air cleaning system 1 comprises a plurality of control device(s) 30 and one or more a plurality of air cleaning devices 10.

FIG. 1 shows an embodiment wherein the control devices **30.1-30.*n* are arranged in a distributed (mesh) topology, a control device 30.1-30.*n* being associated with each air cleaning device 10, 10.1-10.*n*, 10.1-10.*m* of the air cleaning cluster 20. While the control devices 30.1-30.*n* are illustrated as being attached to the air cleaning devices 10, 10.1-10.*n*, 10.1-10.*m*, according to further embodiments of the present disclosure, the control devices 30.1-30.*n* may be integrated into the air cleaning devices 10, 10.1-10.*n*, 10.1-10.*m*. A detailed description of the control devices 30.1-30.*n* is provided in later paragraphs with reference to FIG. 12**.

As illustrated, the air cleaning devices 10, **10.1-10.*n*, 10.1-10.*m* are installed within a room (volume of air), preferably hanging from its ceiling and configured to remove at least a portion of contaminants from the volume of air 100 by recirculating air within the volume of air 100. Illustrated with reference numeral 200, the volume of air 100 is provided with an external ventilation 200 which is not part of the air cleaning system 1 and is not necessarily connected thereto. Nevertheless, a coordinated control of the air cleaning system 1 and the external ventilation 200 is possible and may be advantageous depending on the use case. A detailed description of the air cleaning devices 10, 10.1-10.*n*, 10.1-10.*m* is provided in later paragraphs with reference to FIGS. 10 and 11**.

Further arranged in the room are one or more air quality sensors 40. As illustrated on FIG. 1, the air quality sensors 40 are arranged in the volume of air 100 at various locations. In order to enable an accurate and true measurement of the indoor air quality within the volume of air 100, the air quality sensors 40 are arranged such as to capture representative samples of air. In particular, the air quality sensors 40 are not to be arranged so as to capture exclusively cleaned air expelled by the air cleaning devices 10, **10.1-10.*n*, 10.1-10.*m* or fresh air introduced by the external ventilation 200. Neither are the air quality sensors 40 to be positioned such as to capture exclusively contaminated air. Fluid dynamics simulations may be used in order to determine the expected flow of air within the volume of air 100 so as to determine the positioning of the air quality sensors 40 so as to be able to generate data indicative of air quality within the volume of air 100**.

Determination of air quality involves the collection of air samples by the air quality sensors 40. According to embodiments of the present disclosure, the air quality sensors 40 use light scattering technology to determine mass concentration, preferably in real-time. A sample is drawn from the volume of air 100 into a sensing chamber of the air quality sensor 40 in a continuous stream. One section of the aerosol stream is illuminated with a small beam of laser light. Particles in the aerosol stream scatter light in all directions. A lens at an angle (e.g. 90°) to both the aerosol stream and laser beam collects some of the scattered light and focuses it onto a photo detector. A detection circuitry of the air quality sensor 40 converts the light into a voltage. This voltage is proportional to the amount of light scattered which is, in-turn, proportional to the mass concentration of the aerosol. The voltage is read by a processor and multiplied by an internal calibration constant to yield mass concentration. This value is made available by the air quality sensors 40 as data indicative of air quality. The internal calibration constant is determined from the ratio of the voltage response to known mass concentration of a test aerosol. Light scattering-type air quality sensors 40 respond linearly to the aerosol mass concentration. That is, for a monodisperse aerosol, one particle scatters a fixed amount of light; two particles scatter twice as much light; and 10 particles scatter 10 times as much light. The scattered light is dependent upon particle size. This dependence is most dramatic for particles with diameters (D) less than one third the wavelengths of the laser (~0.25 μm). For these small particles, the scattered light decreases as a function of the sixth power of the diameter. According to embodiments of the present disclosure, the laser diode used by the air quality sensors 40 has a wavelength of 780 nanometres nm which allows detection of particles as small as about 0.1 μm. The scattered light is also dependent upon the index of refraction and light absorbing characteristics of the particles. Light scattering from particles can be modelled using a complex set of equations using Mie light scattering theory. The effect of particle size dependence on the mass concentration computed is greatest for monodisperse aerosols. For use cases when very accurate mass concentration readings are needed to monitor an environment where a specific aerosol type predominates, the air quality sensor 40 is recalibrated for that aerosol. According to embodiments of the present disclosure, the air quality sensor 40 is calibrated against a gravimetric reference using the respirable fraction of standard ISO 12103-1, A1 test dust (Arizona Test Dust). This test dust has a wide size distribution covering the entire size range of the air quality sensor 40 and is representative of a wide variety of ambient aerosols. The wide range of particle sizes averages the effect of particle size dependence on the measured signal. The sensing volume of the air quality sensor 40 is constant and is defined by the intersection of the aerosol stream and the laser beam. Mass is determined from the intensity of light scattered by the aerosol within the fixed sensing volume. Since the sensing volume is known, the information can be easily converted by the air quality sensor 40 to units of mass per unit volume (mg/m3). The optics inside the air quality sensor 40 is kept clean by surrounding the aerosol stream in a sheath of clean filtered air. This sheath air confines the aerosol to a narrow stream and prevents particles from circulating around the optics chamber and collecting on the optics. Besides keeping the optics clean, this allows the air quality sensor 40 to respond quickly to sudden changes in concentration.

According to particular embodiments of the present disclosure, one or more of the air quality sensors 40 are battery-operated, data-logging, light-scattering laser photometers that provide real-time aerosol mass readings. They use a sheath air system that isolates the aerosol in the optics chamber to keep the optics clean for improved reliability and low maintenance. Suitable for clean office settings as well as harsh industrial workplaces, construction and environmental sites and other outdoor applications. The air quality sensors 40 measure aerosol contaminants such as dust, smoke, fumes and mists.

As illustrated with double arrow lines, the control devices **30.1-30.*n* are interconnected to each other by communication links. Furthermore, the control devices 30.1-30.*n* are connected to the air quality sensors 40 by communication links. According to embodiments of the present disclosure, the communication links connecting the control devices 30.1-30.*n* with each other and/or the communication links connecting the control devices 30.1-30.*n* and the air quality sensors 40** are wired (such as Ethernet) and/or radio communication links (such as WiFi, Bluetooth, or mobile telecommunication links).

Figure 2:
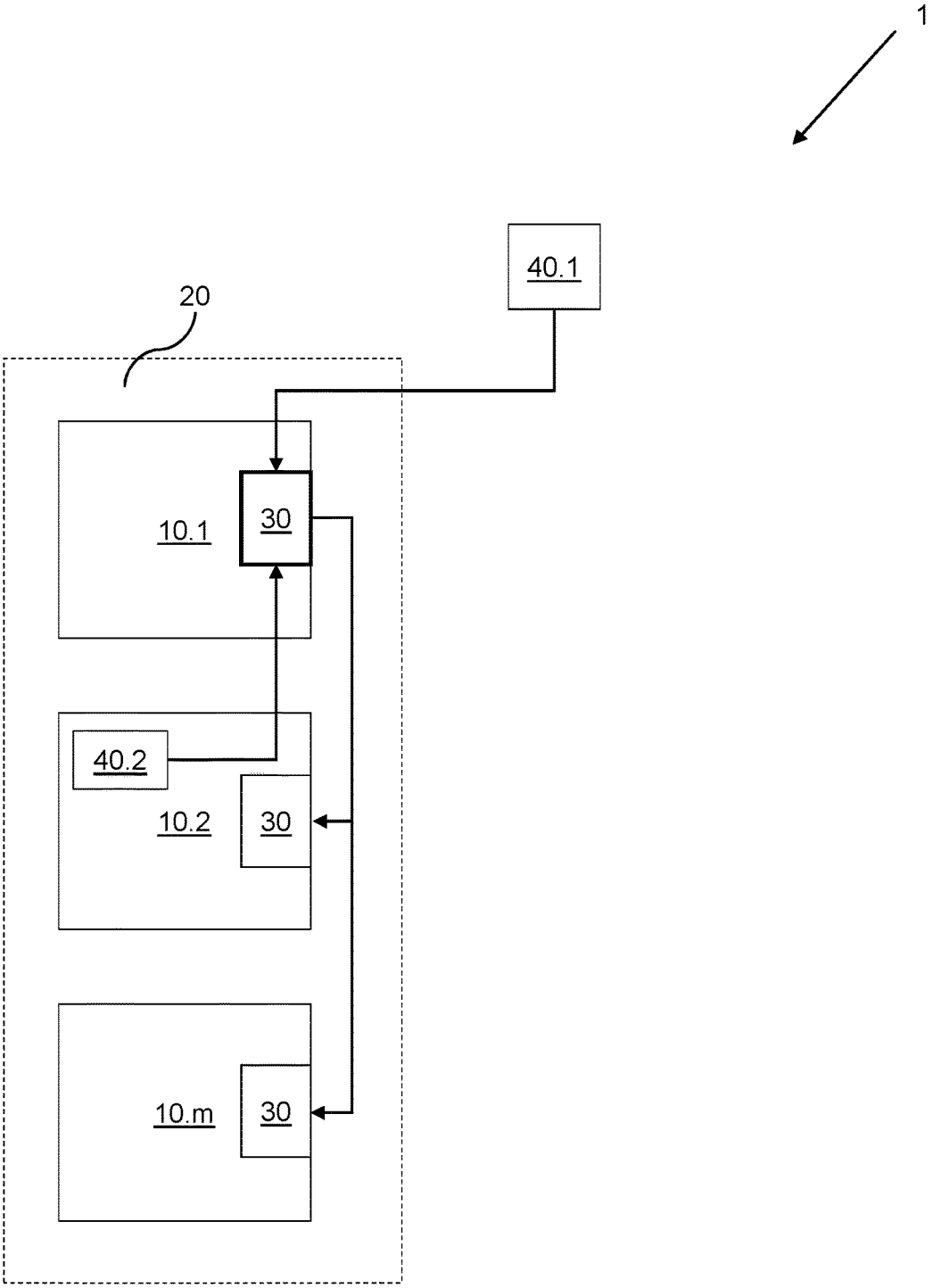
FIG. 2 shows a simplified block diagram of a first embodiment of an air cleaning system according to the present disclosure, deployed in a distributed (mesh) topology.

FIG. 2 shows a simplified block diagram of a first embodiment of an air cleaning system 1 according to the present disclosure, deployed in a distributed (mesh) topology, wherein each air cleaning device 10, **10.1-10.*n* of the air cleaning cluster 20 has a functionally integrated control device 30.1-30.*n*. As illustrated on FIG. 2, one or more of the air quality sensors 40 are (at least functionally) integrated into air cleaning devices 10, 10.1-10.*n*, while one or more air quality sensors 40 are communicatively connected to the control devices 30.1-30.*n*. Since the control devices 30.1-30.*n* are configured to exchange data indicative of air quality, the air quality sensors 40 are directly or indirectly connected to each control device 30.1-30.*n***.

The embodiment according to a mesh network topology as illustrated on FIGS. 1 and 2 is advantageous since the air cleaning system 1 has no single point of failure. Furthermore, air cleaning devices 10 with an integrated/dedicated control device **30.1-30.*n* can easily be deployed into an existing air cleaning cluster 20, thereby extending the mesh network. In a mesh topology, each air cleaning device 10 is "smart" in the sense that it has an integrated/dedicated control device 30.1-30.*n* configured to control the respective air cleaning device 10 as part of the air cleaning cluster 20**.

Figure 3:
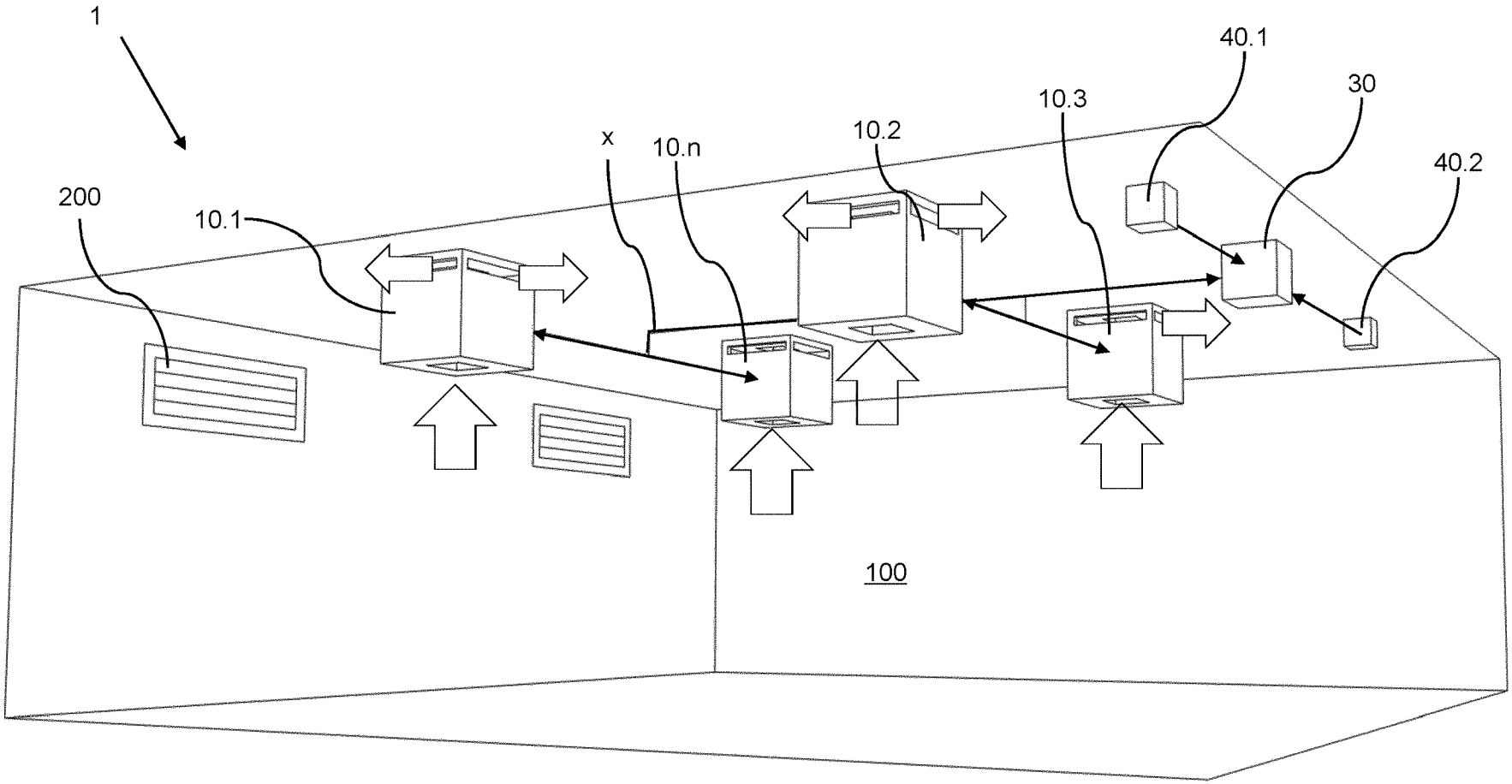
FIG. 3 shows a highly schematic perspective view of a further embodiment of an air cleaning system according to the present disclosure, installed within a room (volume of air) in a centralized (star) topology.
Figure 4:
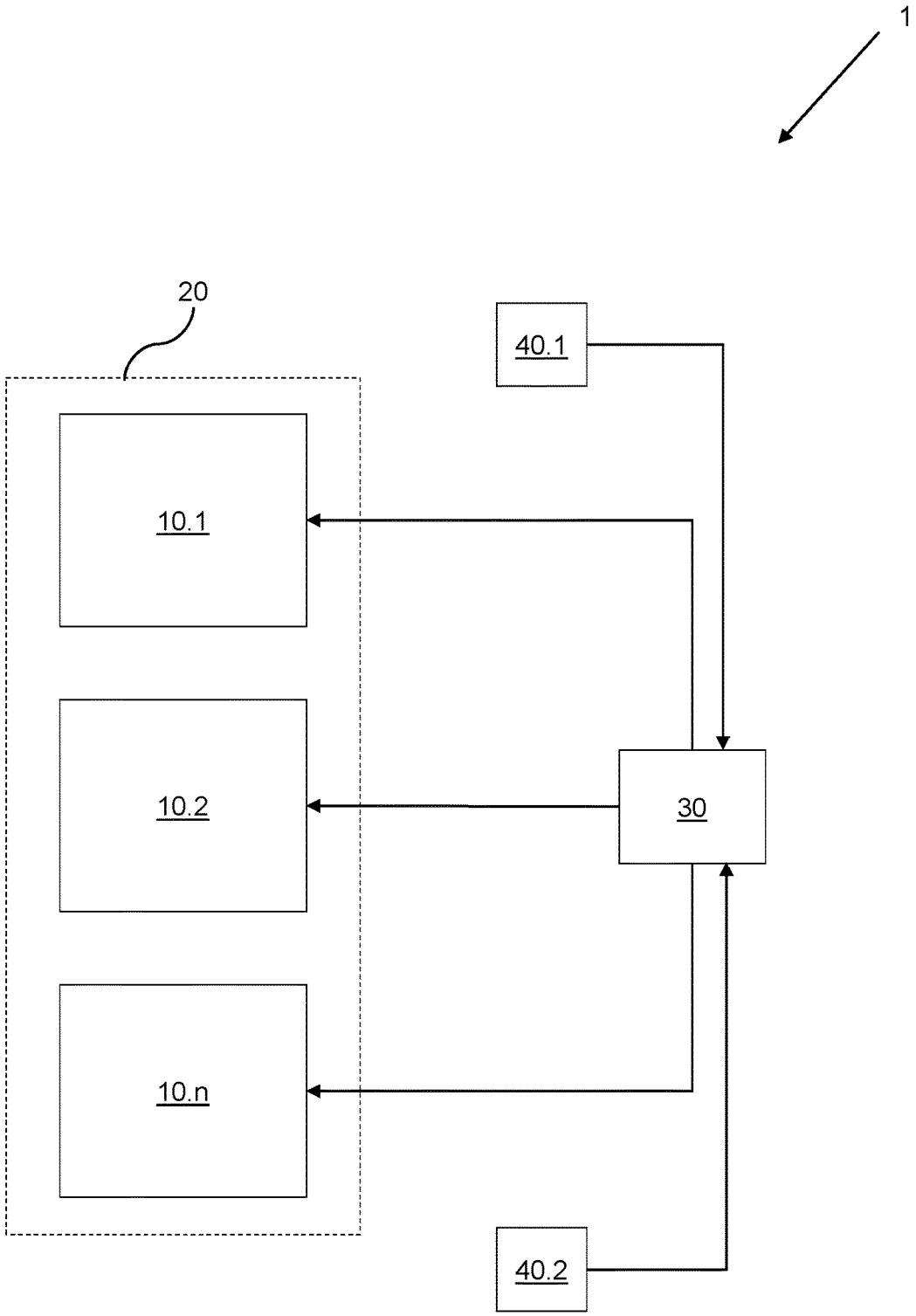
FIG. 4 shows a simplified block diagram of an embodiment of an air cleaning system according to the present disclosure, deployed in a centralized (star) topology.

FIGS. 3 and 4 show a highly schematic perspective view respectively a simplified block diagram of an embodiment of an air cleaning system 1 according to the present disclosure, deployed within a room (volume of air 100) in a centralized (star) topology, wherein the air cleaning system 1 comprises one "master" control device 30 configured to control all air cleaning devices 10, 10.1-10.*n* of the air cleaning cluster 20. Such embodiments are advantageous as not all air cleaning devices 10 need to be "smart" in the sense that they are self-controlling. Instead, the "master" control device 30 is provided to control "non-smart" air cleaning devices 10 (air cleaning devices 10 without an integrated/dedicated control device 30). This reduces the complexity of the individual air cleaning devices 10 and is advantageous in particular for upgrading existing air cleaning systems 1 comprising a plurality of existing air cleaning devices 10, in particular upgrading air cleaning devices 10 of different types or even manufacturers. Having at least one "master" control device 30 connected to a plurality of air cleaning devices 10 of the air cleaning cluster 20 simplifies maintenance of the air cleaning system 1. Furthermore, in a star topology, there is no need for a plurality of control devices 30 to exchange control data indicative of the respective control device 30 controlling one or more of the plurality of air cleaning devices 10.1-10.*n* of the air cleaning cluster 20.

Figure 5:
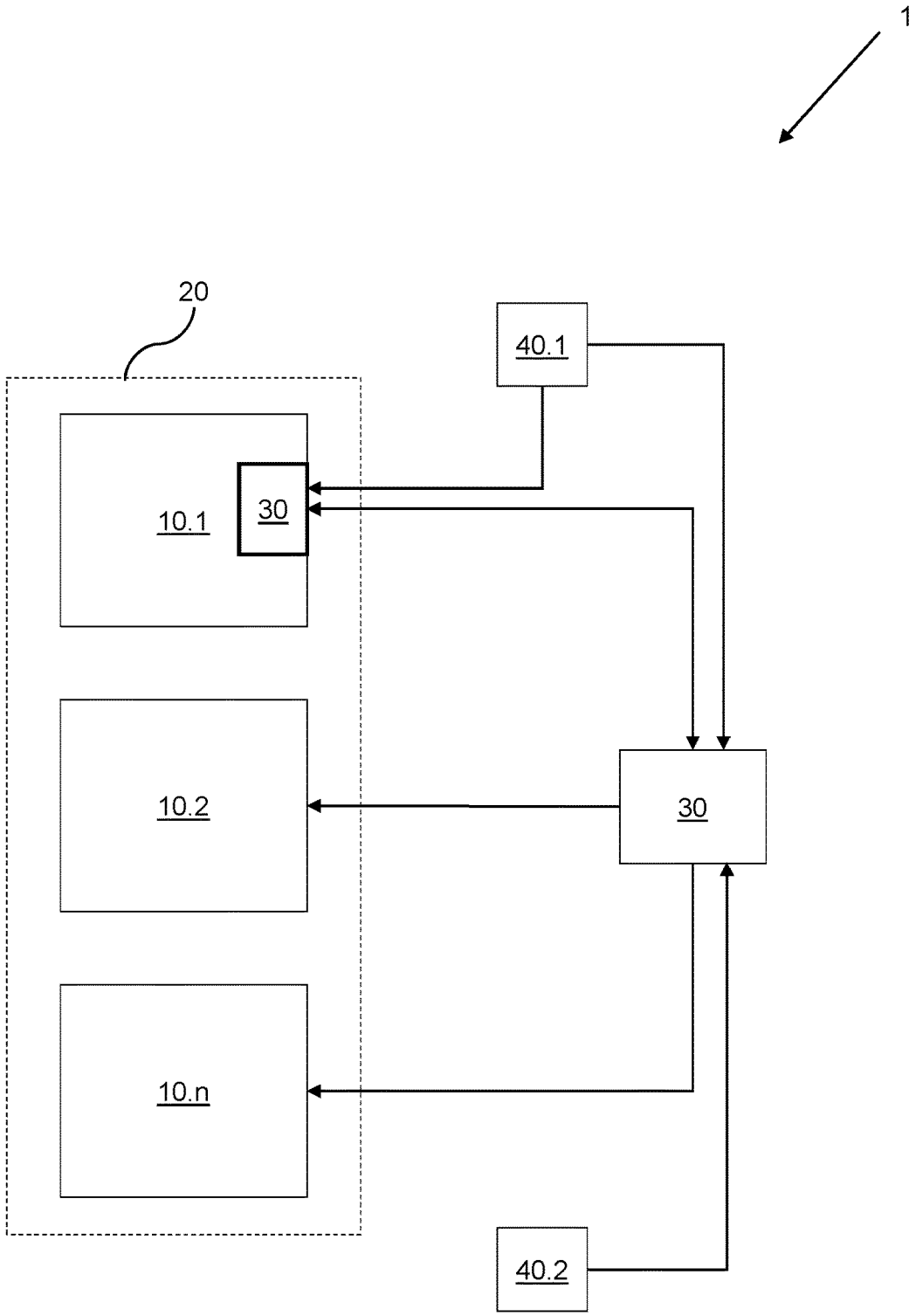
FIG. 5 shows a simplified block diagram of an embodiment of an air cleaning system according to the present disclosure, deployed in a mixed (mesh and star) topology.

FIG. 5 shows a simplified block diagram of an embodiment of an air cleaning system 1 according to the present disclosure, deployed in a mixed (mesh and star) topology, wherein a first air cleaning device 10.1 comprises a functionally (and according to embodiments of the present disclosure also structurally) integrated control device 30, wherein other air cleaning devices 10.2-10.*n* share a common control device 30. A mixed topology combines the advantages of a mesh and a star topology, avoiding single points of failure, while allowing easily upgrading existing "non-smart" air cleaning devices 10 and reducing the need for data exchange between the various control devices 30.

Figure 6:
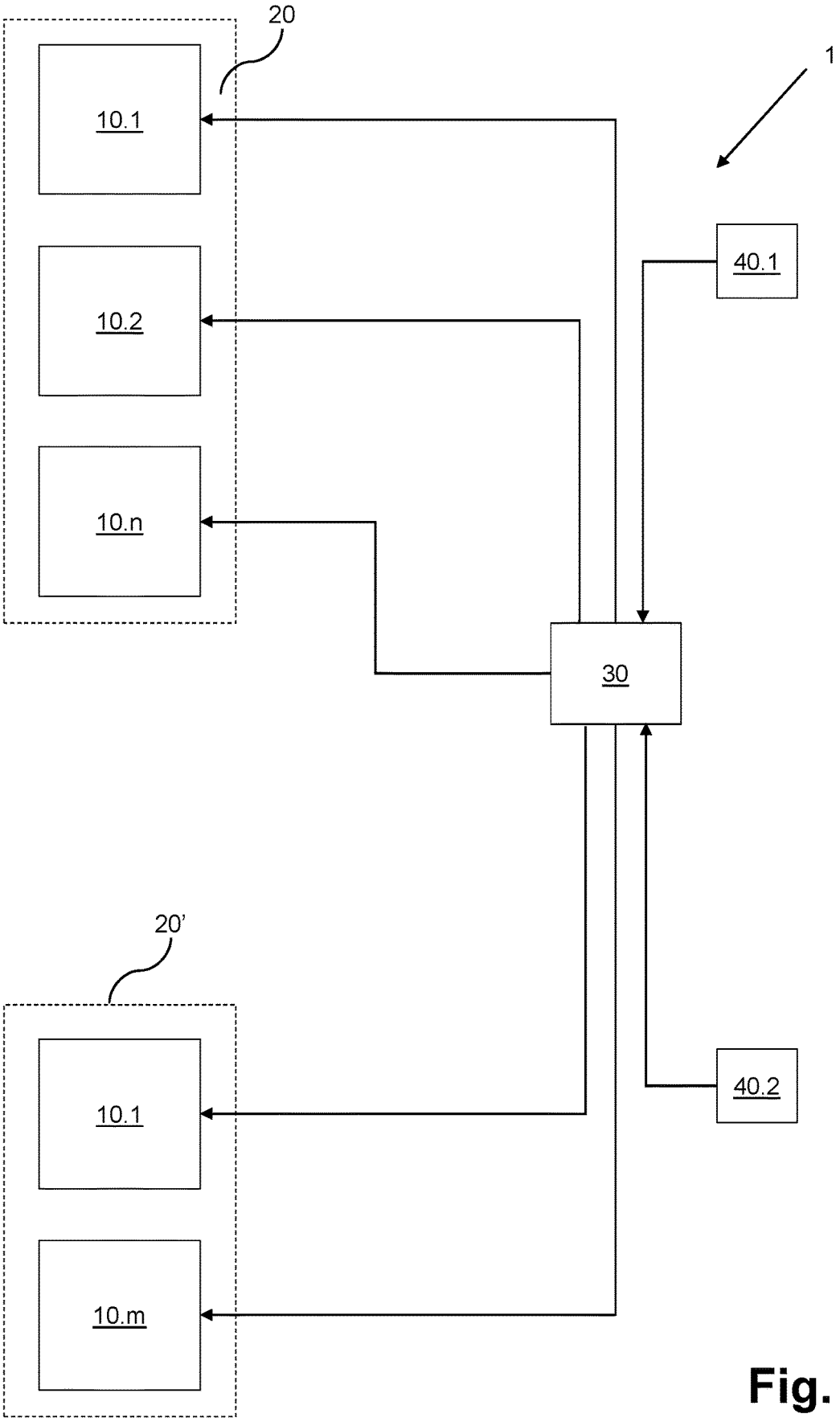
FIG. 6 shows a simplified block diagram of an embodiment of an air cleaning system according to the present disclosure, wherein a single control device is configured to control a plurality of air cleaning clusters.

FIG. 6 shows a simplified block diagram of a further embodiment of an air cleaning system 1 according to the present disclosure, wherein a single control device 30 is configured to control a plurality of air cleaning clusters 20, 20'. Arranging a multitude of air cleaning devices 10.1-10.*n* and 10.1-10.*m* into separate clusters 20, 20' is advantageous in case of large buildings/large indoor spaces with a high number of air cleaning devices 10.1-10.*n*, 10.1-10.*m*, each cluster 20, 20' corresponding to a functional group, simplifying management over a single cluster with a high number of air cleaning devices.

Figure 7:
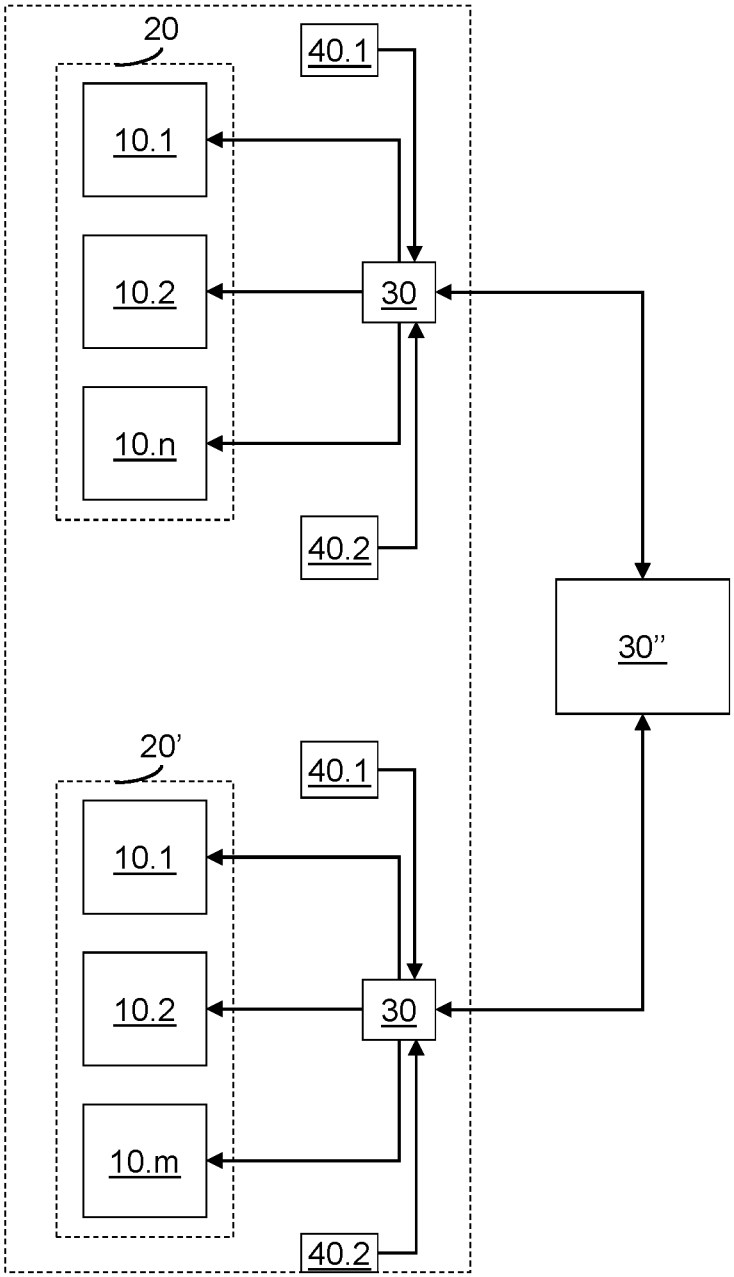
FIG. 7 shows a simplified block diagram of an embodiment of an air cleaning system according to the present disclosure, wherein a plurality of air cleaning clusters are controlled by a plurality of control devices arranged in a hierarchical topology.

FIG. 7 shows a simplified block diagram of an embodiment of an air cleaning system 1 according to the present disclosure, wherein a plurality of air cleaning clusters 20, 20' are controlled by a plurality of control devices 30, 30', 30" arranged in a hierarchical topology. Arranging a plurality of control devices 30, 30', 30" in a hierarchical topology is advantageous in case of large buildings/large indoor space which comprise several areas within the same volume of air 100 with differing requirements as to indoor air quality, each control device 30, 30' being responsible to control a certain area of the volume of air 100, while a further control device 30" is arranged to control the overall system 1.

Figure 8:
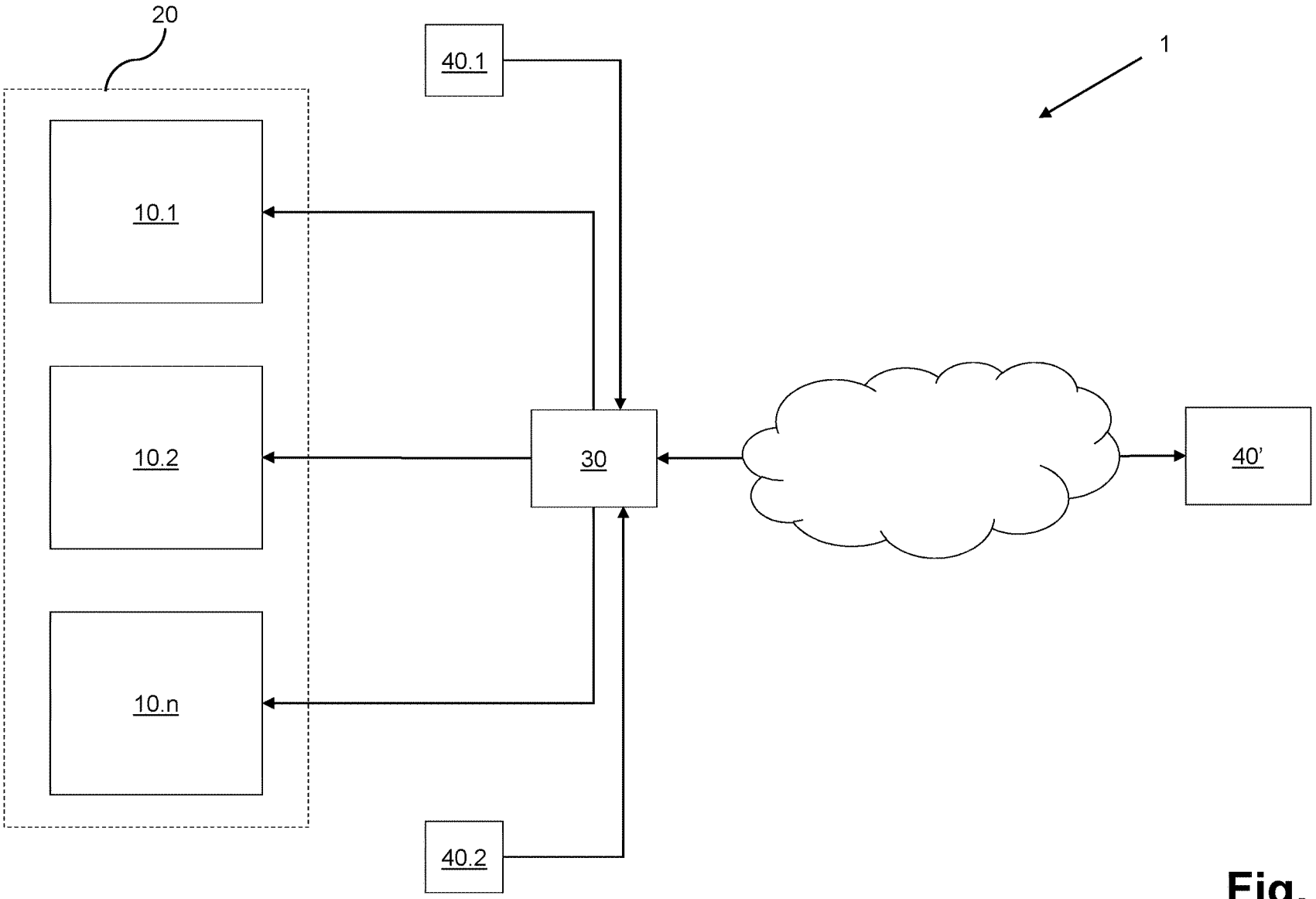
FIG. 8 shows a simplified block diagram of an embodiment of an air cleaning system according to the present disclosure, wherein both local as well as remote air quality sensors/data sources are provided to supply air quality data.

FIG. 8 shows a simplified block diagram of an embodiment of an air cleaning system 1 according to the present disclosure, wherein in addition to local air quality sensors 40, remote air quality data sources 40' are provided to supply air quality data, such as data comprising actual or expected pollen or NOx concentrations. Due to outside air being transferred into the volume of air 100 (inside of the building) by the external ventilation 200, environmental air quality data also has an impact on the indoor air quality.

Figure 9:
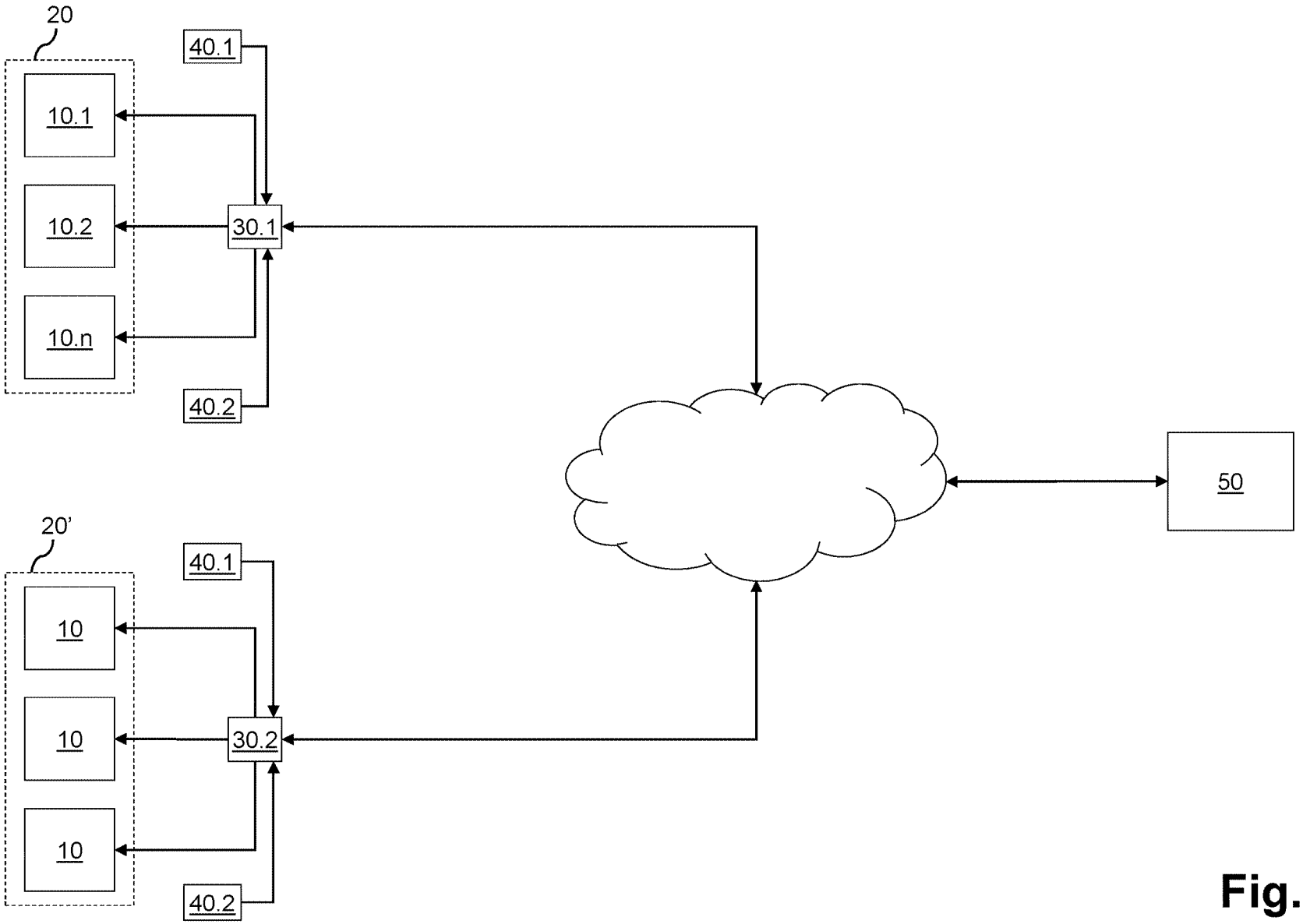
FIG. 9 shows a simplified block diagram of an embodiment of an air cleaning system according to the present disclosure, wherein a plurality of control devices are communicatively connected to a remote computer.

FIG. 9 shows a simplified block diagram of an embodiment of an air cleaning system 1 according to the present disclosure, wherein a plurality of control devices 30.1, 30.2 are communicatively connected to a remote computer 50. The remote computer 50 may be one or more of a remotely located personal computer, a server located in a data server farm and/or or a distributed computing system (cloud). The remote computer 50 is provided to collect and process data from a plurality of air cleaning clusters 20, 20', in particular plurality of air cleaning clusters 20, 20' located in different buildings across different sites, in order to take advantage of the compounded data set throughout a plurality of environments.

Figure 10:
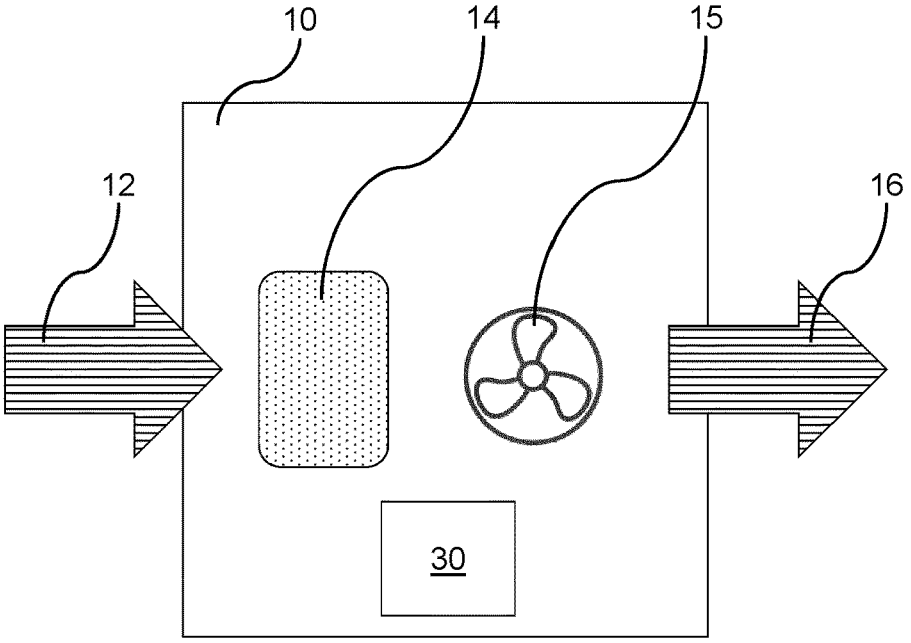
FIG. 10 shows a simplified block diagram of a first embodiment of an air cleaning device according to the present disclosure.
Figure 11:
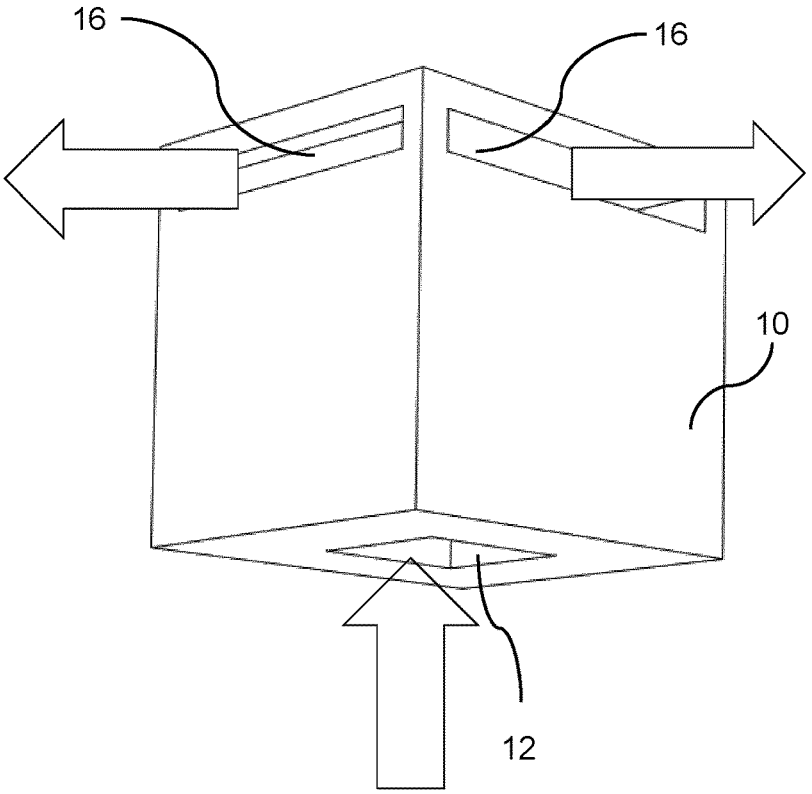

FIGS. 10 and 11 show a simplified block diagram, respectively a highly schematic perspective view of a first embodiment of an air cleaning device 10 according to the present disclosure. As illustrated in FIG. 10, the air cleaning device 10 comprises a control device 30; an air inlet 12; one or more air cleaning filters 14; air propelling means 15; and an air outlet 16. The air cleaning device 10 is configured to draw in air from the volume of air 100 through the air inlet 12; force at least a portion of the drawn-in air through the one or more air cleaning filters 14 to physically capture a portion of contaminants from the portion of the drawn-in air; and return at least a portion of the filtered air through the air outlet 16 back to the volume of air 100. The removal of airborne particulate is accomplished through mechanical, aerodynamic, and/or electrostatic means. According to embodiments of the present disclosure, the air cleaning device(s) 10 are configured to remove, i.e., filter out gas phase contaminants in the volume of air, in particular by molecular phase filtration. Molecular phase filtration refers to the filtration of gaseous contamination having size at the molecular scale (also called Gas Phase Filtration).

Mechanical air cleaning filters remove particles from the airstream as particles come in contact with the surface of fibres in the filter media and stick on to the fibres. Mechanical air cleaning filters operate based on sieving/straining, impaction/impingement, interception and/or diffusion of the contaminant particles.

Electrostatic filtration is a method for removing dust by letting air passing through an ionizer screen where electrons colliding with air molecules generate positive ions which adhere to dust and other small particles present, giving them a positive charge. The charged dust particles then enter a region filled with closely spaced parallel metal plates alternatively charged with positive and negative voltages. Positive plates repel the charged particles which are attracted by and retained on the negative plates by electrostatic forces, further supplemented by intermolecular forces, causing the dust to agglomerate. According to embodiments of the present disclosure, fibers are electrostatically pre charged and attract particles without an ionizer pre step.

According to embodiments of the present disclosure, the air cleaning filter 14 is a device composed of fibrous materials which removes solid particulates such as dust, pollen, mold and bacteria from the air flowing through it. Whether particulate or gas phases filters, they rely on a complicated set of mechanisms to perform their function. In many cases, more than one of these mechanisms comes into play. Many new technologies have been employed in the effort to improve on the quality and performance of air cleaning filters 14, and in some cases to reduce their Life Cycle Cost (LCC). Some notable areas where advancement has been pursued are reduction in pressure drop and the application of various treatments to filter fibers.

An air cleaning filter 14 deteriorates over the course of its lifetime with respect to efficiency on the target contaminants, contaminant holding capacity and energy input requirement, etc. Filter efficiency, dust holding capacity and differential pressure can be measured in many ways, as the performance of an air cleaning filter 14 changes over time. The challenge imposed on air cleaning filters 14 changes as the environment inside and outside of a building changes. Many air cleaning filter testing methods have been developed by various organizations for predicting the in-use performance of filters and for comparing the performance of air cleaning filters of different designs.

The air cleaning devices 10 are configured to make available (e.g. though a data communication link) data indicative of their operational state. According to embodiments of the present disclosure, the operational state comprises data indicative of air cleaning filter performance. The performance of an air cleaning filter is generally evaluated based on four parameters. These include:

Contaminant removal efficiency: Determined by challenging the air cleaning filter 14 with contaminant on the upstream side and measuring the residual contaminant on the downstream side of the air cleaning filter 14 after the air has passed through the media.

Contaminant holding capacity: Determined by measuring the mass of contaminant removed before the air cleaning filter 14 reaches its maximum differential pressure in the case of particle filters 14 or before the contaminant breaks through the air cleaning filter 14 in the case of a gaseous filter.

Resistance to airflow: Determined by measuring the pressure of the air upstream of the air cleaning filter 14 and downstream of the filter 14 and comparing those values. The value of resistance to airflow must be accompanied by the value of airflow velocity in order to characterize the performance of the air cleaning filter 14.

Safety: Measured by an air cleaning filter's 14 resistance to fire when no other fuel source is present (the filter is therefore a fuel source), the amount of smoke generated by the filter 14, and the release of sparks by the filter 14 when exposed to the heat of a flame.

According to embodiments of the present disclosure, the operational state comprises data indicative of air cleaning filter 14 changing interval. The changing interval (lifetime) of the air cleaning filter 14 is highly dependent on how dirty the environment it is installed in. According to embodiments of the present disclosure the changing interval is between 6-12 months in most environments. In hard-contaminated environments the lifetime may be reduced down to 2-3 months, or even down to 1-2 weeks or days.

As symbolically illustrated on FIG. 10, the air cleaning device 10 further comprises air propelling means 15 such as a fan. The air propelling means 15 is an electrically powered device used to produce an airflow for the purpose of drawing in air from the volume of air 100 through the air inlet 12; forcing at least a portion of the drawn-in air through the one or more filters 14 to physically capture a portion of contaminants from the portion of the drawn-in air; and returning at least a portion of the filtered air through the air outlet 16 back to the volume of air 100. According to embodiments of the present disclosure, the air propelling means 15 comprises a fan having a revolving vane or vanes used for producing an air current. The type and size of the fan of the air propelling means 15 is determined based on the amount of air that needs to be moved (e.g. based on the required Clean Air Delivery Rate of the air cleaning device 10). Furthermore, the type of fan is determined based on the required pressure differential between the inlet 12 and outlet 16. The air propelling means 15 further comprises an electrical motor for driving the fan. According to embodiments of the present disclosure, the air propelling means 15 comprises an Electronically Commutated EC motor, a brushless DC motor. Basic DC motors rely on carbon brushes and a commutation ring to switch the current direction, and therefore the magnetic field polarity, in a rotating armature. The interaction between this internal rotor and fixed permanent magnets induces its rotation. In an EC motor, the mechanical commutation has been replaced by electronic circuitry which supplies the right amount of armature current in the right direction at precisely the right time for accurate motor control. The electric motor according to embodiments of the present disclosure is further simplified by using a compact external rotor design with stationary windings. The permanent magnets are mounted inside the rotor with the fan impeller attached.

According to embodiments of the present disclosure, the operational state of the air cleaning devices 10 comprises data indicative of the clean air delivery rate CADR of the respective air cleaning device 10. Clean Air Delivery Rate CADR is a figure of merit that is the volume of air delivered in a time period (e.g. $m^3/h$) that has had all the contaminant particles of a given size distribution removed.

For air cleaning devices 10 that have air flowing through its filters 14, CADR is the fraction of particles (of a particular size distribution) that have been removed from the air, multiplied by the air flow rate (in $m^3/h$) through the air cleaning device 10.

Air volume is often described as air exchange (the number of times the total volume of air in a room is processed by the air cleaning device 10 within a given period of time). CADR on the other hand not just shows how much air is cleaned nor just what percentages of particles are removed, but the overall performance of the filtration system 14 when both factors are examined. In other words, CADR shows how much volume of clean air the air cleaning device 10 is actually delivering to the volume of air 100.

In summary, according to embodiments of the present disclosure, the operational state of the air cleaning devices 10 comprises data indicate of:

- Revolutions per minute RPM of the fans of the air propelling means 15;
- Air flow (Speed settings);
- Date/Time logging events with respect to the operation of the air cleaning device 10;
- Pressure drop (Pascal) over the filters 14;
- Energy consumption of the air cleaning device 10;
- Temperature(s) in the motor/electronics of the air propelling means 15;
- Motor state/alarm(s);
- air cleaning filter 14 clogging calculations on an individual air propelling means 15; and
- Sensor connectivity.

Figure 12:
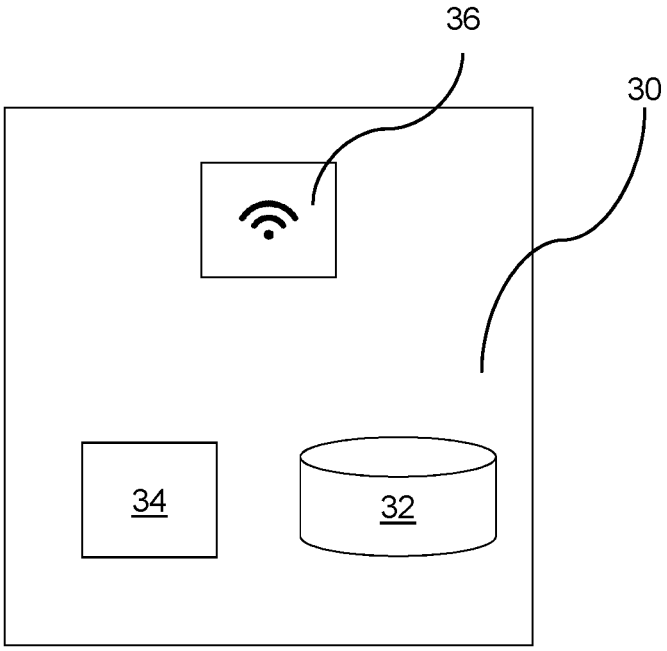
FIG. 12 shows a simplified block diagram of a first embodiment of a control device according to the present disclosure.

FIG. 12 shows a simplified block diagram of a first embodiment of a control device 30 according to the present disclosure. As schematically illustrated, the control device 30 comprises processing means 32 and storage means 36, the storage means 36 comprising computer-executable instructions, which when executed by the processing means 32 cause the control device 30 to carry out the method according to one of the embodiments disclosed herein. In the embodiment shown on FIG. 12, the control device 30 further comprises a communication unit 36 configured to establish data communication links with other control devices **30.1-30.*n*; with air cleaning devices 10; and with air quality data sources and/or air quality sensor(s) 40. According to further embodiments of the present disclosure, the communication unit 36 is further configured to establish a data communication link with a remote computer 50**.

FIGS. 13 through 16 show flowcharts illustrating various embodiments of the method of operating an air cleaning cluster 20 according to the present disclosure.

Figure 13:
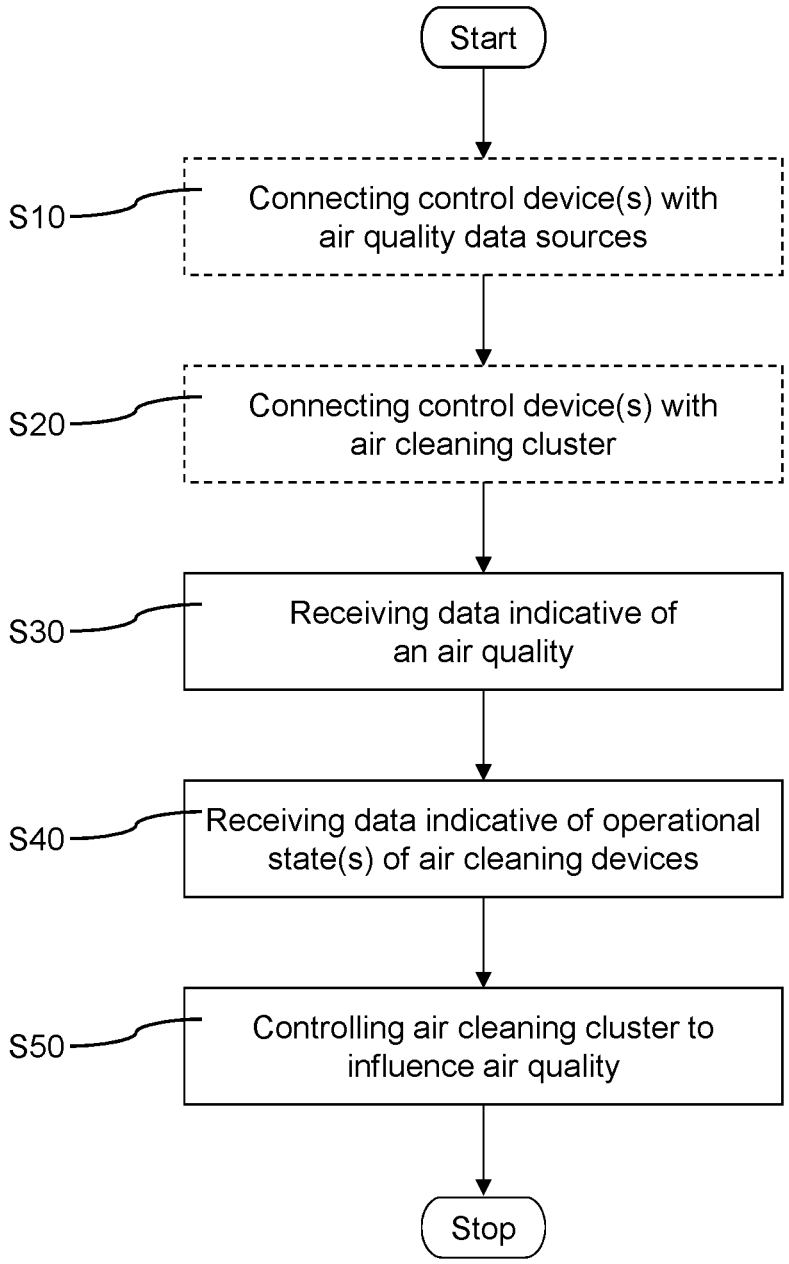
FIG. 13 shows a flow diagram illustrating a sequence of steps of a first embodiment of the method of operating an air cleaning cluster according to the present disclosure.

FIG. 13 shows a flow diagram illustrating a sequence of steps of a first embodiment of the method of operating an air cleaning cluster 20 according to the present disclosure. In a first preparatory step S10, the control device(s) 30 is/are communicatively connected with the air quality sensors 40, by wired and/or wireless communication links. In a further preparatory step S20, the control device(s) 30 is/are communicatively connected with the air cleaning devices 10 of the air cleaning cluster 20, by wired and/or wireless communication links.

Thereafter, in a step S30, the one more control device(s) 30 receive data indicative of air quality within the volume of air 100 (from one or more air quality data sources and/or air quality sensors 40). The data indicative of air quality comprises measurement values such as concentration(s), distribution, of particular contaminant(s)/particle(s).

In a step S40—preceding, simultaneous or following step S30, the control device(s) 30 (in particular the processor 34 thereof) receive data indicative of operational state(s) of the plurality of air cleaning devices 10.1-10.*n* from the plurality of air cleaning devices 10 of the air cleaning cluster 20. The data indicative of operational states of the air cleaning devices 10.1-10.*n* comprises data such as load level and/or filter degradation level of the plurality of air cleaning devices 10.

Having both air quality data and operational state data available, in a step S50, the control device(s) 30 controls the one or more of the plurality of air cleaning devices 10.1-10.*n* of the air cleaning cluster 20 such as to influence the indoor air quality within the volume of air 100, using the data indicative of the indoor air quality and the data indicative of an operational state of the plurality of air cleaning devices 10.1-10.*n*. In particular, the step of controlling the air cleaning cluster 20 comprises controlling one or more of plurality of air cleaning devices 10.1-10.*n* of the air cleaning cluster 20 such that the data indicative of air quality from the one or more air quality data sources and/or air quality sensors 40 corresponds to an indoor air quality target value. According to embodiments of the present disclosure, the indoor air quality target value is a constant value or a value changing according to a schedule, such as an indoor air quality target value schedule determined corresponding to scheduled activity within the volume of air 100.

Figure 14:
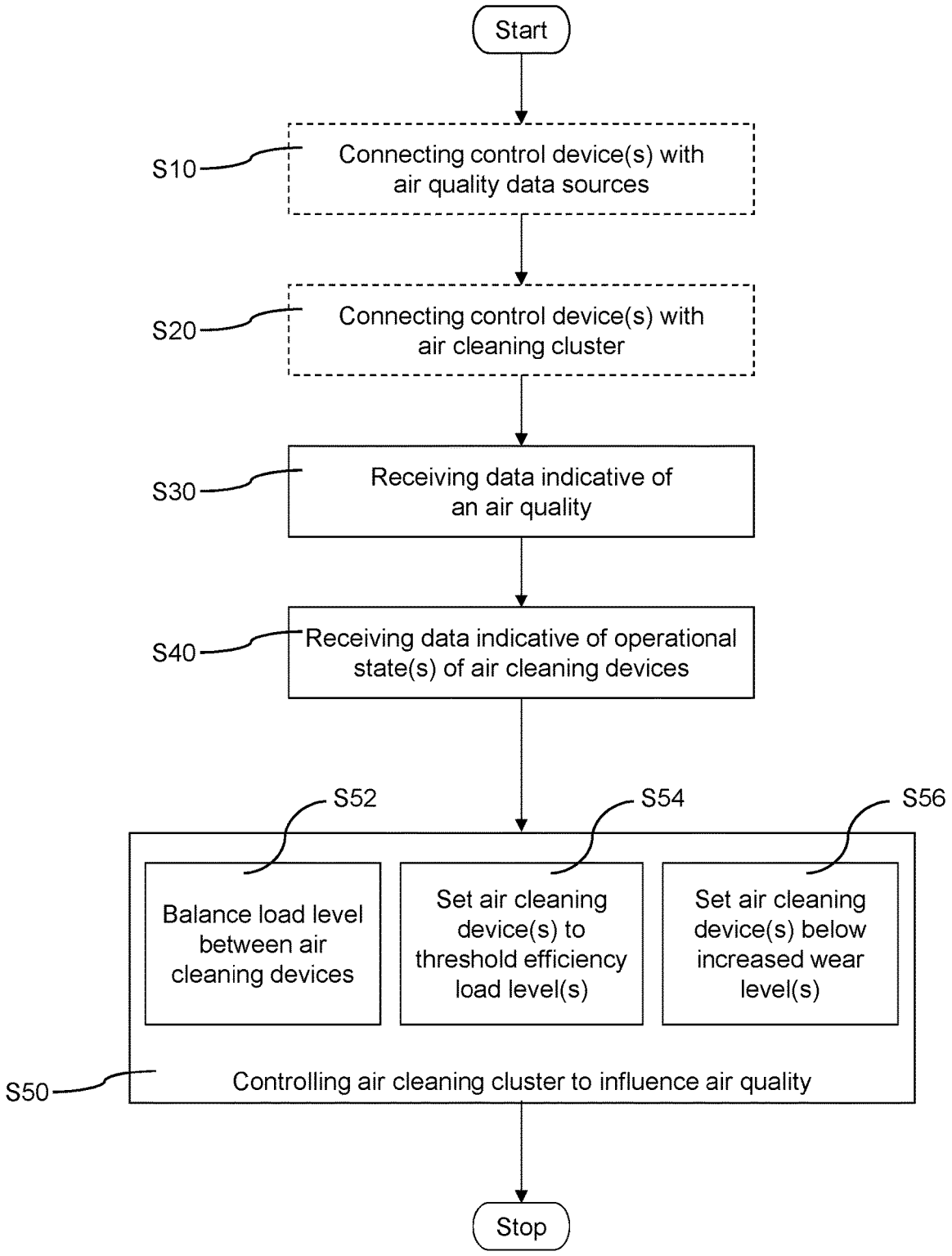
FIG. 14 shows a flow diagram illustrating a sequence of steps of an embodiment of the method of operating an air cleaning cluster according to the present disclosure.

FIG. 14 shows a flow diagram illustrating a sequence of steps of an embodiment of the method of operating an air cleaning cluster 20 according to the present disclosure, wherein the operational state(s) comprise data indicative of load level(s) of the plurality of air cleaning devices 10.1-10.*n* (e.g. 10% load, 10 W of 100 W max load, 10 m3/h of a max of 100 m3/h load, etc.), the method further comprising the control device 30 controlling the air cleaning cluster 20 such as to: In a sub-step S52, achieve a load balance between the plurality of air cleaning devices 10.1-10.*n*. The load balance may be an equal load between the plurality of air cleaning devices 10.1-10.*n* or a balanced load based on the type and concentration of contaminants as measured by the air quality sensor(s) 40.

In a sub-step S54, set one or more of the plurality of air cleaning devices 10.1-10.*n* to a load level at or below a threshold efficiency level. Even though having a higher maximum capacity (e.g., higher amount of clean air delivery rate), certain air cleaning devices 10 are most energy efficient up to a certain load level. For example, the increase of air resistance of certain air cleaning filters 14 (the pressure drop between the inlet and outlet side of the air cleaning filters) with the increase of air volume is non-linear. Therefore, in order to improve energy efficiency, according to embodiments of the present disclosure, the load is distributed between several air cleaning devices 10 such as to ensure that each air cleaning device 10 is operating efficiently vs. the entire air cleaning load being carried by a single air cleaning device 10 operating at a high but inefficient load while other air cleaning devices 10 are idle. Energy efficiency is expressed for example as the amount of energy required to deliver a certain flow rate of clean air W/(m3/h).

In a sub-step S56, set one or more of the plurality of air cleaning devices 10.1-10.*n* below an increased wear level. Beyond becoming inefficient, even though having a higher maximum capacity (e.g., higher amount of clean air delivery rate), certain air cleaning devices 10, in particular the air cleaning filters 14 thereof are prone to increased wear beyond a certain load level. Therefore, in order to prolong the lifetime of air cleaning devices 10, according to embodiments of the present disclosure, the load is distributed between several air cleaning devices 10 such as to ensure that none of the air cleaning devices 10 is operating beyond their increased wear level.

Furthermore, according to embodiments of the present disclosure, as part of step S50, the control device 30 controls one or more of the plurality of air cleaning devices 10, 10.1-10.*n* of the air cleaning cluster 20, 20' such as to maintain air quality by prioritizing, i.e. increasing the load level, of one or more air cleaning devices 10, 10.1-10.*n* (located in high priority locations) and lowering the load level of other air cleaning devices 10, 10.1-10.*n* (located in lower priority locations) if the aggregated power consumption of the air cleaning cluster 20 exceeds a set maximum power consumption.

Figure 15:
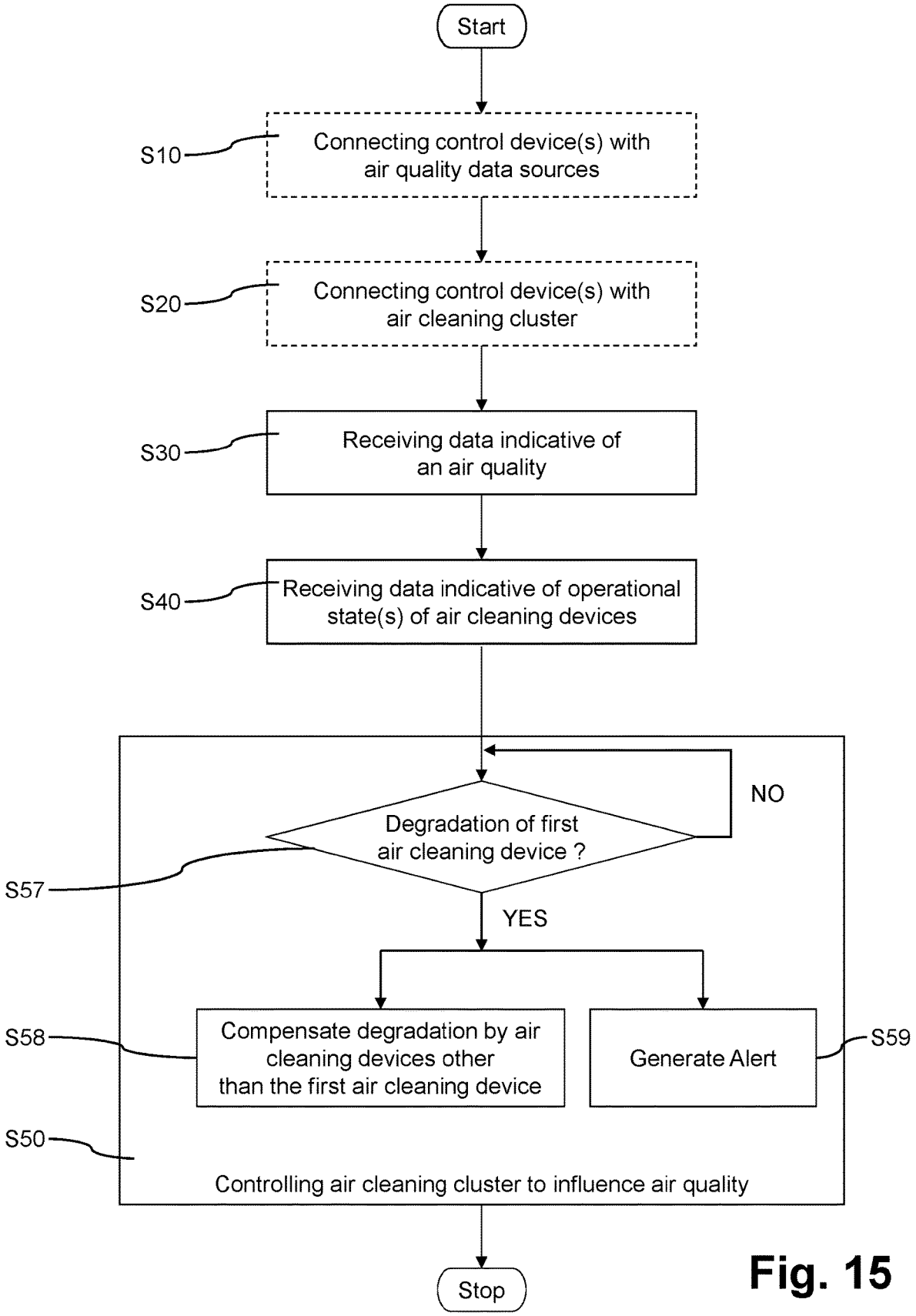
FIG. 15 shows a flow diagram illustrating a sequence of steps of an embodiment of the method of operating an air cleaning cluster according to the present disclosure.

FIG. 15 shows a flow diagram illustrating a sequence of steps of an embodiment of the method of operating an air cleaning cluster 20 according to the present disclosure, wherein the operational state(s) comprises data indicative of a degradation level of the plurality of air cleaning devices 10.1-10.*n*. In a step S57, the control device 30 monitors the degradation level of the plurality of air cleaning devices 10.1-10.*n*. If in step S57, the control device 30 determines that a first of the plurality of air cleaning devices 10 is degraded, the control device 30 controls, in step S58, one or more of the plurality of air cleaning devices 10.2-10.*n* other than a first air cleaning device 10.1 such as to compensate for the degradation level of a first air cleaning device 10.1. The step "compensate for the degradation level of the first air cleaning device 10.1" comprises the process of increasing the power (load level) of cleaning device(s) 10.2-10.*n* other than the first air cleaning device at least temporarily until servicing/replacement of the degraded first air cleaning device 10.1. The temporal increase of the load level of one or more air cleaning devices 10.2-10.*n* (other than the first air cleaning device 10.1) may go even beyond the above-mentioned balance; threshold efficiency and/or increased wear levels.

The degradation level comprises data indicative of percentage of remaining contaminant removal efficiency, contaminant holding capacity and resistance to airflow of the air cleaning filters 14. Additionally, the degradation level comprises data indicative of a degradation of further components of the air cleaning devices 10, such as the air propelling means 15. According to embodiments of the present disclosure, the control device 30 switches the first air cleaning device 10.1 into a service state if the data indicative of a degradation level is above a service threshold and in step S59 generates an alert signal identifying the first air cleaning device 10.1. The alert signal may be an audible, a visual signal and/or an alert message sent by data communication means, for example to a system owner, a service technician, a back office, or even R&D for statistical purposes.

Figure 16:
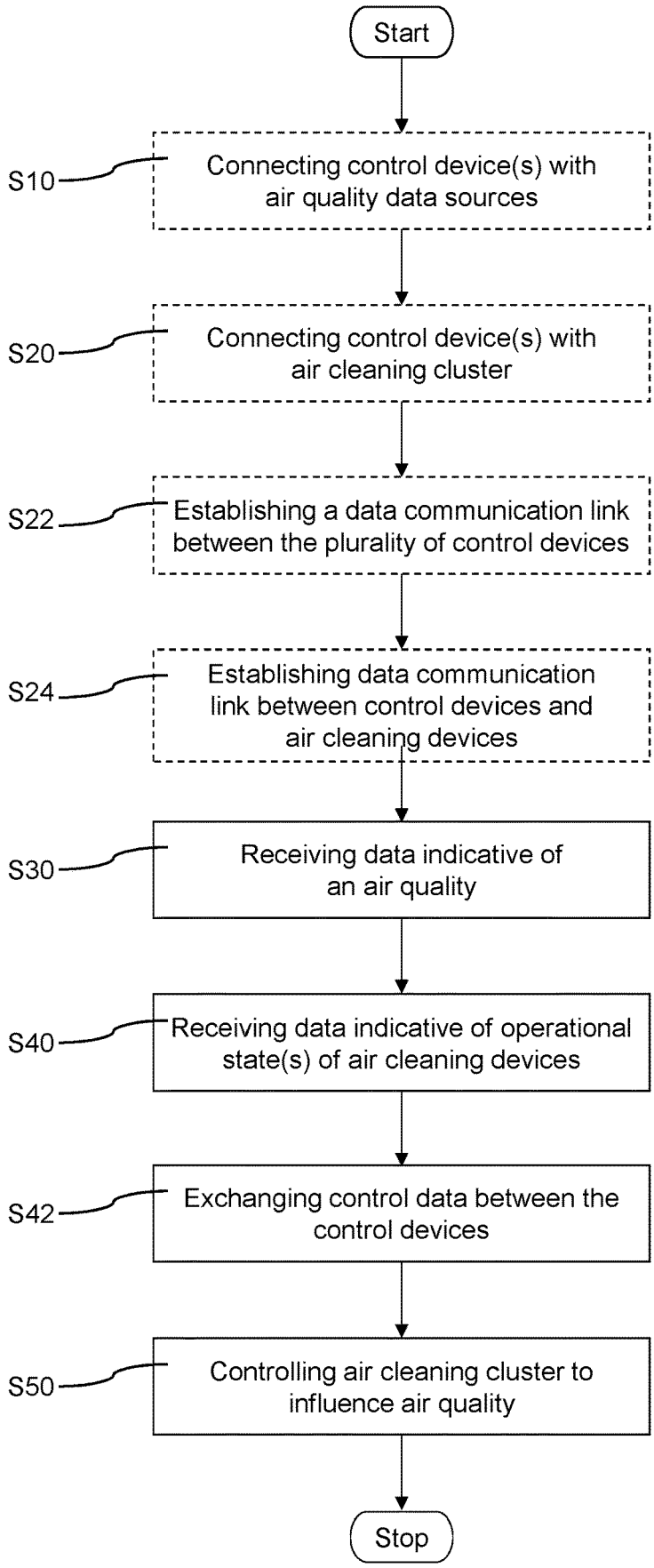
FIG. 16 shows a flow diagram illustrating a sequence of steps of an embodiment of the method of operating an air cleaning cluster according to the present disclosure.

FIG. 16 shows a flow diagram illustrating a sequence of steps of an embodiment of the method of operating an air cleaning cluster 20 according to the present disclosure, in particular an air cleaning cluster 20 deployed in a mesh or mixed topology. As shown on FIG. 16, in a preparatory step S22, data communication links are established between the plurality of control devices 30.1-30.*n*. In a further preparatory step S24, data communication links are established between each of the plurality of control devices 30.1-30.*n* and one or more of the plurality of air cleaning devices 10.1-10.*n*. Furthermore, in a step S42, the plurality of control devices 30.1-30.*n* exchange data indicative of the respective control device 30.1-30.*n* controlling one or more of the plurality of air cleaning devices 10.1-10.*n* of the air cleaning cluster 20.

It should be noted that, in the description, the sequence of the steps has been presented in a specific order, one skilled in the art will understand, however, that the computer program code of the computer implemented method may be structured differently and that the order of at least some of the steps could be altered, without deviating from the scope of the disclosure.

The invention claimed is:

1. A computer implemented method of operating an air cleaning cluster (20, 20') comprising a plurality of air cleaning devices (10, 10.1-10.*n*) arranged in a room comprising a volume of air (100), the method comprising:

receiving, by one or more control device(s) (30, 30', 30" 30.1-30.*n*), data indicative of air quality within the volume of air (100);

receiving, by the control device(s) (30, 30', 30" 30.1-30.*n*), data indicative of operational state(s) of the plurality of air cleaning devices (10, 10.1-10.*n*); and the control device(s) (30, 30', 30" 30.1-30.*n*) controlling one or more of the plurality of air cleaning devices (10, 10.1-10.*n*) of the air cleaning cluster (20, 20') such as to influence the indoor air quality within the volume of air (100), using the data indicative of the indoor air quality and the data indicative of an operational state of the plurality of air cleaning devices (10, 10.1-10.*n*), wherein the step of controlling the air cleaning cluster (20, 20') comprises controlling the plurality of air cleaning devices (10, 10.1-10.*n*) of the air cleaning cluster (20, 20') such that the data indicative of the air quality corresponds to an indoor air quality target value; and wherein the step of controlling the air cleaning cluster (20, 20') comprises controlling the plurality of air cleaning devices (10, 10.1-10.*n*) to remove at least a portion of contaminants from the volume of air (100) by recirculating within the volume of air (100) comprised by the room in which the plurality of air cleaning devices (10, 10.1-10.*n*) are arranged in, the recirculation comprising drawing in air through an air inlet (12) of each air cleaning device (10, 10.1-10.*n*), forcing, by air propelling means (15), at least a portion of the drawn-in air through one or more air cleaning filters (14) of each air cleaning device (10, 10.1-10.*n*) to physically capture a portion of contaminants from the portion of the drawn0in air, and returning at least a portion of the filtered air through an air outlet (16) of each air cleaning device (10, 10.1-10.*n*).

2. The method according to claim 1, wherein the one or more control device(s) (30, 30', 30",30.1-30.*n*) comprises a plurality of control devices (30, 30', 30" 30.1-30.*n*), the method further comprising:

establishing a data communication link between the plurality of control devices (30, 30', 30" 30.1-30.*n*);

establishing a data communication link between each of the plurality of control devices (30, 30', 30" 30.1-30.*n*) and one or more of the plurality of air cleaning devices (10, 10.1-10.*n*); and the plurality of control devices (30, 30', 30" 30.1-30.*n*) exchanging data indicative of the respective control device (30, 30', 30" 30.1-30.*n*) controlling one or more of the plurality of air cleaning devices (10, 10.1-10.*n*) of the air cleaning cluster (20, 20').

3. The method according to claim 1, wherein the operational state(s) comprise data indicative of a load level of the plurality of air cleaning devices (10, 10.1-10.*n*), the method further comprising the control device (30, 30', 30" 30.1-30.*n*) controlling the air cleaning cluster (20, 20') such as to:

achieve a load balance between the plurality of air cleaning devices (10, 10.1-10.*n*); and/or set one or more of the plurality of air cleaning devices (10, 10.1-10.*n*) to a load level of a threshold efficiency level; and/or set one or more of the plurality of air cleaning devices (10, 10.1-10.*n*) to a load level below an increased wear level.

4. The method according to claim 1, wherein the operational state(s) comprises data indicative of a degradation level of a first air cleaning device (10.1) of the plurality of air cleaning devices (10, 10.1-10.*n*), the method further comprising the control device (30, 30', 30" 30.1-30.*n*) controlling one or more of the plurality of air cleaning devices (10.2-10.*n*) other than the first air cleaning device (10.1) such as to compensate for the degradation level of the first air cleaning device (10.1).

5. The method according to claim 4, further comprising:

the control device (30, 30', 30" 30.1-30.*n*) switching the first air cleaning device (10.1) into a service state; and/or generate an alert signal identifying the first air cleaning device (10.1), if the data indicative of a degradation level is above a service threshold.

6. The method according to claim 1, wherein the data indicative of air quality comprises data indicative of a contamination type within the volume of air (100), the method further comprising:

receiving, by the control device (30, 30', 30" 30.1-30.*n*), data indicative of a contamination type each of the plurality of air cleaning devices (10) is configured to remove from the volume of air (100); and the control device (30, 30', 30" 30.1-30.*n*) controlling the air cleaning cluster (20, 20') using the data indicative of a contamination type each of the plurality of air cleaning devices (10) is configured to remove and the data indicative of a contamination type of the volume of air (100).

7. The method according to claim 1, further comprising:

the control device (30, 30', 30" 30.1-30.*n*) receiving data indicative of an expected indoor air quality impact;

the control device (30, 30', 30" 30.1-30.*n*) controlling the air cleaning cluster (20, 20') further using the data indicative of an expected air quality impact.

8. The method according to claim 1, further comprising:

a remote server (50) collecting data indicative of indoor air quality and data indicative of operational state(s) from a plurality of air cleaning clusters (20, 20') arranged within a plurality of volumes of air (100, 100');

the remote server (50) generating control parameters using the data collected from the plurality of air cleaning clusters (20, 20');

the remote server (50) transmitting the control parameters to the control device(s) (30, 30', 30" 30.1-30.*n*); and the control device(s) (30, 30', 30" 30.1-30.*n*) controlling the air cleaning cluster (20, 20') further using the control parameters transmitted by the remote server (50).

9. A control device (30, 30', 30" 30.1-30.*n*) comprising processing means (32) and storage means (36), the storage means (36) comprising computer-executable instructions, which when executed by the processing means (32) cause the control device (30, 30', 30" 30.1-30.*n*) to carry out the method according to claim 1.

10. An air cleaning device (10) comprising:

a control device (30, 30', 30" 30.1-30.*n*) according to claim 9;

an air inlet (12);

one or more air cleaning filters (14);

air propelling means (15); and an air outlet (16), the air cleaning device (10) being configured to remove at least a portion of contaminants from a volume of air (100) by recirculation within the volume of air (100) comprised by a room in which the air cleaning device (10, 10.1-10.*n*) is arranged in, the recirculation comprising drawing in air from the volume of air (100) through the air inlet (12);

forcing, by the air propelling means (15), at least a portion of the drawn-in air through the one or more air cleaning filters (14) to physically capture a portion of contaminants from the portion of the drawn-in air; and returning at least a portion of the filtered air through the air outlet (16) back to the volume of air (100).

11. An air cleaning system (1) comprising:

an air cleaning cluster (20, 20') comprising a plurality of air cleaning devices (10) arranged in a room comprising a volume of air (100), the plurality of air cleaning devices (10) configured to remove at least a portion of contaminants from the volume of air (100) by recirculation within the volume of air (100) comprised by the room within which the plurality of air cleaning devices (10, 10.1-10.*n*) are arranged, and configured to make available data indicative of their operational state(s);

one or more air quality data sensors (40, 40.1-40.2, 40') configured to measure an air quality within the volume of air (100) and to make available data indicative of air quality within the volume of air (100); and one or more control device(s) (30, 30', 30" 30.1-30.*n*) according to claim 9.

12. The air cleaning system (1) according to claim 11, wherein the control device(s) (30, 30', 30" 30.1-30.*n*) is/are located physically remote from the air cleaning devices (10).

13. The air cleaning system (1) according to claim 11, wherein the control devices (30, 30', 30" 30.1-30.*n*) are comprised by the plurality of air cleaning devices (10).

14. A computer program product comprising computer-executable instructions, which when executed by a processing unit (34) of one or more control device(s) (30, 30', 30" 30.1-30.*n*) cause the control device(s) (30, 30', 30" 30.1-30.*n*) to carry out the method according to claim 1.

* * * * *